US011384931B2

(12) United States Patent
Warren et al.

(10) Patent No.: US 11,384,931 B2
(45) Date of Patent: Jul. 12, 2022

(54) LIGHTING AND SPEAKER DEVICE AND ANNULAR LED ASSEMBLY

(71) Applicant: Zuma Array Limited, London (GB)

(72) Inventors: Morten Warren, South Oxshott (GB); Fong Ming, Hong Kong (CN); Laurence Dickie, Brighton (GB); Philip John Rimmer, London (GB); John Daniell Hebert, San Francisco, CA (US); Ed Rose, London (GB)

(73) Assignee: Zuma Array Limited, London (GB)

( * ) Notice: Subject to any disclaimer, the term of this patent is extended or adjusted under 35 U.S.C. 154(b) by 0 days.

(21) Appl. No.: 17/047,712

(22) PCT Filed: Apr. 16, 2019

(86) PCT No.: PCT/GB2019/051082
§ 371 (c)(1),
(2) Date: Oct. 15, 2020

(87) PCT Pub. No.: WO2019/202310
PCT Pub. Date: Oct. 24, 2019

(65) Prior Publication Data

US 2021/0164645 A1 Jun. 3, 2021

(30) Foreign Application Priority Data

Apr. 16, 2018 (GB) ..... 1806194
Sep. 26, 2018 (GB) ..... 1815709

(51) Int. Cl.
*F21V 33/00* (2006.01)
*F21V 29/76* (2015.01)
(Continued)

(52) U.S. Cl.
CPC ..... *F21V 33/0056* (2013.01); *F21S 8/026* (2013.01); *F21V 5/046* (2013.01); *F21V 7/041* (2013.01);
(Continued)

(58) Field of Classification Search
CPC ..... F21V 33/0056; F21V 29/76; F21V 5/046; F21V 7/041; F21V 23/003;
(Continued)

(56) References Cited

U.S. PATENT DOCUMENTS 10,219,061 B2 * 2/2019 Cook ..... H04R 9/022
2004/0175014 A1 9/2004 Liu
(Continued)

FOREIGN PATENT DOCUMENTS

EP 3190336 7/2017
KR 10-2011-0066606 6/2011

OTHER PUBLICATIONS

International Search Report and the Written Opinion dated Jun. 19, 2019 From the International Searching Authority Re. Application No. PCT/GB2019/051082. (15 Pages).
(Continued)

*Primary Examiner* — Bao Q Truong

(57) ABSTRACT

A combined lighting and speaker device having a central longitudinal axis defining a forward and a rearward direction and a radially outward and a radially inward direction is provided. The device comprises a tweeter; a tweeter horn positioned radially outwardly of the tweeter; a speaker positioned rearward of the tweeter horn; and a light emitting diode, LED, assembly positioned radially outwardly of the tweeter. The LED assembly comprises one or more light emitting diodes, LEDs, and a lens having a forward surface. The tweeter horn has an inner edge in communication with an outer edge of the tweeter, so that the tweeter horn forms
(Continued)

a guide to direct sound produced by the tweeter away from the speaker when in use. At least part of the tweeter horn is provided by the forward surface of the lens.

17 Claims, 24 Drawing Sheets

(51) Int. Cl.

| | |
|---|---|
| ***F21S 8/02*** | (2006.01) |
| ***F21V 5/04*** | (2006.01) |
| ***F21V 7/04*** | (2006.01) |
| ***F21V 23/00*** | (2015.01) |
| ***H04R 1/02*** | (2006.01) |
| ***H04R 1/28*** | (2006.01) |
| *F21Y 103/33* | (2016.01) |
| *F21Y 113/10* | (2016.01) |
| *F21Y 115/10* | (2016.01) |

(52) U.S. Cl.
CPC ..... *F21V 23/003* (2013.01); *F21V 29/76* (2015.01); *H04R 1/028* (2013.01); *H04R 1/2865* (2013.01); *F21Y 2103/33* (2016.08); *F21Y 2113/10* (2016.08); *F21Y 2115/10* (2016.08)

(58) Field of Classification Search
CPC ..... F21V 33/0052; F21S 8/026; H04R 1/028; H04R 1/2865; F21Y 2103/33; F21Y 2113/10; F21Y 2115/10
See application file for complete search history.

(56) References Cited

U.S. PATENT DOCUMENTS

| | | | | |
|---|---|---|---|---|
| 2008/0298045 | A1* | 12/2008 | Wright | F21V 33/0056 362/86 |
| 2010/0316247 | A1 | 12/2010 | Ding | |
| 2014/0204586 | A1 | 7/2014 | Roberge et al. | |
| 2016/0295308 | A1* | 10/2016 | Battyanyi | H04R 1/26 |
| 2017/0219173 | A1* | 8/2017 | Yotsumoto | G02B 6/0045 |

OTHER PUBLICATIONS

Patents Act 1977: Search Report Under Section 17(5) dated Aug. 31, 2018 From the Intellectual Property Office of the United Kingdom of Great Britain Re. Application No. GB1806194.5. (4 Pages).

* cited by examiner

LIGHTING AND SPEAKER DEVICE AND ANNULAR LED ASSEMBLY

RELATED APPLICATIONS

This application is a National Phase of PCT Patent Application No. PCT/GB2019/051082 having International filing date of Apr. 16, 2019, which claims the benefit of priority of United Kingdom Patent Applications Nos. 1806194.5 filed on Apr. 16, 2018, and 1815709.9 filed on Sep. 26, 2018. The contents of the above applications are all incorporated by reference as if fully set forth herein in their entirety.

FIELD AND BACKGROUND OF THE INVENTION

The present invention relates to a lighting and speaker device, and also to an annular LED assembly for use in a lighting and speaker device.

Speaker Nomenclature

FIG. 1 shows a sectional view of a known speaker device 100. Speaker device 100 comprises a roll surround 110, chassis 112, cone 114, dust cap, 116, spider 118, tinsel 120, voice coil former 122, radial magnets 124, voice coil, 126, voice coil air gap 128, outer steel, 130, pole piece steel 132 and terminals 134.

Objectives

An object of the present invention is to provide an improved integrated speaker and downlight (combined lighting and speaker device) for flush mount ceiling installation.

Desirably, a combined lighting and speaker "smart light" device according to the present invention should provide a replacement for regular light fittings installed in the home. For example, devices according to the present invention may be installed to replace GU10 downlight fittings. In order to replace such fittings easily, it is desirable that the devices have a similar size to the fitting that it replaces. In some cases an increase in size of around 5% is acceptable.

Preferably, the combined lighting and speaker device should emit at least 700 Lumens. This is so that the smart light devices produce equivalent or better illumination than standard halogen bulbs.

The speaker arrangement of the combined lighting and speaker device should have similar acoustic properties to commercially available mono point speakers. Such as SoundTouch 10™, Bose™ and Sonos Play1™.

Combined Lighting and Loudspeaker Devices According to Earlier Embodiments not in Accordance with the Present Invention A number of different embodiments were developed to address this above-mentioned objective. In a first particular example, a device includes a single full range speaker. Such a speaker should be capable of delivering good reproduction of high frequency (HF) and low frequency (LF) input signals.

FIG. 2 shows a sectional view of a combined lighting and speaker device 200 as described above. Device 200 comprises a LED lens 210, three-LED board 212, condensing heat pipe 214, LED stem 216, full-range drive unit 218, case 220 and heatsink 222. Such a device is similar to devices that are the subject of patent publication WO 2016/135517.

Light emitting diodes (LEDs) are integrated into the device by removing the dust cap of the speaker and mounting a small number (for example, 1 to 6) High output LEDs on a stem that runs through voice coil former and seats on the pole piece.

High lumen output LED's are intrinsically less efficient compared to lower output LED packages, therefore, for every watt of power put in they will produce more watts of waste heat.

Excessive heating of LEDs can significantly shorten the life span of the LEDs or cause them stop working. To manage the waste heat in this embodiment, it is therefore necessary to run a condensing heat pipe from the LED stem through the pole piece of the drive and out to a heatsink at the back of the case.

Systems including a single full range drive unit, as described above, have drawbacks in terms of the quality of the sound that is produced.

Speakers Systems Containing Coaxially Integrated Tweeters

In order to address these drawbacks, a separate tweeter may be added to the assembly and integrated with the speaker. In speaker systems not containing LEDs, there are two possible approaches to integrating a tweeter coaxially within a drive unit.

Type 1 is shown in FIG. 3*a*. In this example, the tweeter is positioned above the pole piece and is flush with the top of the voice coil former and the start of the cone. This is simple and provides good acoustic performance. Integrating lighting with this arrangement presents significant problems wherever the lights are placed. FIG. 3*b* illustrates some possible positions of the lighting assembly 310. If the light is placed to surround this tweeter 312 as in position 310A then the movement of the voice coil would cause the light to flicker. If the light is pulled forward to midway between bezel and tweeter as shown in position 310B then acoustic reflections on the rear of the lights will hinder HF acoustic performance. If the lights are placed flush with the bezel as shown in position 310C then glare from LEDs becomes an issue.

Type 2 is shown in FIG. 3*c*. In this example, the tweeter is mounted on stem that projects out from the top of the voice coil former, the tweeter and case can then be of a larger diameter than the voice coil.

Both designs suffer from air leak round the voice coil air gap which reduces LF performance. They require a second roll surround 314 between voice coil former and chassis, below the suspension, or sealed suspension.

For either of the coaxially integrated tweeter arrangements described above, the heat path through the centre of the voice coil is no longer available because the tweeter is in the way. Thus a new approach to LED integration is required.

SUMMARY OF THE INVENTION

In accordance with a first aspect of the present invention, a combined lighting and speaker device is provided. The device has a central longitudinal axis defining a forward and a rearward direction and a radially outward and a radially inward direction. The device comprises a tweeter, a tweeter horn positioned radially outwardly of the tweeter, a speaker positioned rearward of the tweeter horn, and a light emitting diode, LED, assembly. The LED assembly is positioned radially outwardly of the tweeter. The LED assembly comprises one or more light emitting diodes, LEDs, and a lens having a forward surface. The tweeter horn has an inner edge in communication with an outer edge of the tweeter, so that the tweeter horn forms a guide to direct sound produced by the tweeter away from the speaker when in use. At least part of the tweeter horn is provided by the forward surface of the lens.

The speaker may be used to provide low frequency range sounds and the tweeter may be used to provide higher frequency range sounds. Advantageously, the sound quality is improved over full range single speaker devices by providing separate speaker and tweeter components for LF and HF sound ranges respectively.

By providing a tweeter cone, HF sound from the tweeter may be directed away from the LF speaker. Advantageously, interference of the HF sound with the LF speaker is reduced by the presence of the horn. The lens may be configured such that the light is a lambertian source or directed as a spot. In conjunction with this, fresnel features on the lens could be used to direct the spot by rotating the lens, rather than changing the angle of the light source itself.

Lighting may be integrated into the device by providing an LED assembly wherein the lens of the LED assembly forms part of the tweeter horn. This provides a compact solution with high quality light and sound in a single device.

The tweeter horn may comprise a cup part and an inner edge of the cup part may be in communication with an outer edge of the forward surface of the lens. The cup part may be positioned radially outwardly of the lens.

Alternatively, the lens of the LED assembly may provide substantially all of the tweeter horn, without the need for an additional cup part.

The tweeter horn may comprise a rim part having an inner edge that is in communication with the outer edge of the cup part. An outer edge of the rim part may comprise one or more notches through which sound from the speaker can travel when in use. The tweeter horn may be positioned radially outwardly of the cup part.

By providing a tweeter horn with a "feathered" rim, the overall sound quality may be improved by allowing sound from the LF speaker to travel through the notches in the tweeter horn, whilst still providing a tweeter horn capable of directing the HF sound away from the LF speaker.

The cup and the rim of the tweeter horn may be formed from a single piece of material.

The one or more LEDs may be mounted rearward of the lens (in a "horizontal" manner—i.e. facing forwards) so that light is emitted by each of the LEDs in a generally forward direction towards the lens when in use.

The LED assembly may further comprise a reflector configured to reflect light from the LEDs towards the lens when in use. In other words, the reflector may direct light from the LEDs in a forward direction. The reflector may be positioned rearward of the lens.

The one or more LEDs may be mounted so that light is emitted by each of the LEDs in a generally inward direction towards the reflector. The LEDs may be mounted radially outwardly of the reflector in a "vertical" manner.

Alternatively, the LEDs may be mounted in a "vertical" manner so that light from the LEDs is emitted in a generally outward direction towards the reflector. The reflector may be positioned radially outwardly of the LEDs and direct light forwards towards the lens.

The reflector may comprise one or more frustoconical surfaces. Alternatively, the surfaces may be frustopyramidal.

In the case of LEDs being mounted vertically and configured to direct light inwards, the reflector may be an outer frustoconical surface.

In the case of LEDs being mounted horizontally to direct light forwards, two reflectors may be provided—one inwardly of the LED ring and one outwardly. An outer furstoconical surface may be provided radially inwardly of the LEDs and an inner frustoconical surface may be provided radially outwardly of the LEDs. This configuration allows light from the LEDs to be directed forwards even if the light is emitted from the LED at an angle to the forward direction. This improves the amount of light from the LEDs that is directed into the room (e.g. through the lens) and improves the efficiency of the arrangement.

Additional reflectors may be placed between the LEDs in the ring to further increase the amount of light that is directed forwards into the room.

The reflector may comprise a plurality of individual reflector surfaces. These surfaces may be frustoconical or may be substantially planar (or a combination). This is illustrated in FIG. 12.

The lens may be an annular lens. Alternatively, the lens may comprise a plurality of individual lenses, which may together form an annular lens arrangement.

An inner edge of the forward surface of the lens may be in communication with the outer edge of the tweeter. This can ensure that HF sound from the tweeter is directed into the horn (provided at least partially by the lens) and forwards, away from the tweeter and from the speaker.

Alternatively, the tweeter horn may further comprise a throat part. An inner edge of the throat part of the tweeter horn is may be in communication with the outer edge of the tweeter and an outer edge of the throat part may be in communication with an inner edge of the forward surface of lens. This alternative arrangement provides a separate throat to direct sound from the tweeter into the tweeter horn and allows improved control over the shape of the tweeter horn. Horns with an exponential profile may be preferred in some cases.

The tweeter horn may be frustoconical or frustopyramidal. Additionally or alternatively, specific components of the tweeter horn may be frustoconical or frustopyramidal. For example, one or more of the cup, the rim and the throat of the tweeter horn may be frustoconical or frustopyramidal. These may be inner frustoconical surfaces.

A carrier supporting the tweeter and the LED assembly may be provided. The carrier may be arranged to conduct heat from the one or more LEDs to tweeter horn. This can provide a way for heat from the LEDs to be dissipated. For example, the cup and/or the rim of the tweeter horn may conduct heat away from the LEDs and radiate the heat into the room. This may thereby dissipate heat produced by the LEDs when in use. This configuration may reduce the operating temperature of the LED and therefore improve the efficiency of the LEDs. This can also prevent or deduce damage to the LEDs caused by overheating.

The carrier may be supported by the tweeter horn. For example, the carrier may be mechanically fastened to the cup of the tweeter horn.

The tweeter horn and the carrier may be formed from a single piece of material. Advantageously, this can simplify construction and assembly and improve surface area for heat transfer from the LEDs. This also removes split lines from cosmetic surfaces.

The device may further comprise a chassis that supports the speaker.

The tweeter horn may be connected to and supported by the chassis. For example, the rim or cup of the tweeter horn may be mechanically fastened to and supported by the chassis.

The device may further comprise a support frame that is connected to and supported by the chassis. The support frame may support the tweeter horn and/or the carrier.

The device may further comprise: a controller supported by the chassis; and a plurality of wires configured to supply power and control signals from the controller to the tweeter and the one or more LEDs.

The wires may run along and be supported by the support frame (if present) or may run along and be supported by the tweeter horn. The wires may be in the form of a ribbon cable or may be formed by photo etched tracks on the tweeter horn.

In accordance with a second aspect of the present invention, an annular light emitting diode, LED, assembly for use in a combined lighting and speaker device comprising a tweeter is provided. The LED assembly has a central longitudinal axis defining a forward and a rearward direction and a radially outward and a radially inward direction. The LED assembly comprises one or more light emitting diodes, LEDs, arranged in a ring, an annular lens (or lens arrangement) and an annular reflector (or reflector arrangement) configured to reflect light from the LEDs towards the lens when in use. The reflector may be positioned rearward of the lens and configured to reflect light from the LEDs forwards.

This embodiment has particular advantages over prior art LED assemblies. The LED assembly of the present invention is more compact that previous assemblies. Moreover, the reflector may be used as colour mixing chamber to obtain a desired colour temperature.

The LEDs may be low power LEDs. Advantageously, a heat pipe may not be required to operate the LEDs of this assembly. This allows the LED assembly to be integrated into a combined light and loudspeaker device more flexibly.

The LED assembly according to the second aspect provides a compact and efficient solution for integrating LEDs into a combined light and speaker device.

The one or more LEDs may be mounted so that light is emitted by each of the LEDs in a generally inward direction towards the reflector. For example, the LEDs may be mounted radially outwardly of the reflector in a vertical manner so that light from the LEDs is emitted inwards towards the reflector and then directed forwards by the reflector towards the lens.

Alternatively, the LEDs may be mounted vertically so that light from the LEDs is emitted in a generally outward direction towards the reflector. The reflector may be positioned radially outwardly of the LEDs and direct light forwards towards the lens.

The reflector may comprise one or more frustoconical (or frustopyramidal) surfaces.

The one or more LEDs may comprise one or more LEDs having a first colour and one or more LEDs having a second colour different from the first colour.

The LEDs in the ring may be arranged so that each LED having the first colour is adjacent to an LED having the second colour.

The present invention also provides a combined lighting and speaker device having a central longitudinal axis defining a forward and a rearward direction and a radially outward and a radially inward direction. The combined lighting and speaker device comprises: a chassis; an annular light emitting diode, LED, assembly as described above; and a speaker supported by the chassis and positioned rearward of the assembly.

The combined lighting and speaker device may further comprise a tweeter positioned radially inwardly of the assembly.

The combined lighting and speaker device may further comprise a support frame that is connected to and supported by the chassis. The support frame may support the assembly.

The combined lighting and speaker device may further comprise a grille supported by the chassis and configured to support the assembly. The grille may be a pressed grille. Advantageously, the grille removes heat from the LEDs by conducting heat away from the LED assembly and radiating it into the room when the device is in use.

Electrically conductive tracks may be provided on the grille and configured to supply power to the assembly when in use.

Electrical contacts for the tracks may be provided in the frame.

The combined lighting and speaker device may further comprise a pole piece positioned at least partly along the central longitudinal axis and connected to and supported by the chassis. The pole piece may be configured to support the assembly.

The pole piece may be used to conduct heat away from the LED assembly. The heat may be conducted towards the chassis of the device or the thermal mass of the magnet steel.

In accordance with a third aspect of the present invention, a combined lighting and loudspeaker device having a central longitudinal axis defining a forward and a rearward direction and a radially outward and a radially inward direction is provided. The device comprises a lighting assembly; a speaker positioned rearward of the lighting assembly; and a power storage component. The power storage component is configured to supply power to the lighting and loudspeaker device when the lighting and loudspeaker device is not connected to a mains power supply.

The lighting assembly may be an LED assembly as described above.

The lighting assembly may be positioned radially inwardly of the speaker.

The combined lighting and loudspeaker device may further comprise a power storage component. The power storage component may be configured to supply power to the lighting and loudspeaker device when the lighting and loudspeaker device is not connected to a mains power supply.

The power storage component may be a rechargeable battery or a capacitor.

The power storage component is contained within a housing of the lighting and loudspeaker device.

The power storage component may be contained in a housing that is separate from a housing of the lighting and loudspeaker device and electrically connected to the speaker and the lighting assembly (an "umbilical" housing).

The present invention also provides a kit of parts that can be assembled to provide a device or assembly as described above.

The present invention also provides a method of manufacturing a device, assembly or kit of parts as described above.

According to the present invention, an assembly as described above may be used in a combined lighting and loudspeaker device.

Features and advantages described in relation to one aspect of the invention may also be applied to another aspect of the invention. For example, the LED assembly of the first aspect may comprise one or more LEDs having a first colour and one or more LEDs having a second colour different from the first colour, which may be arranged so that each LED having the first colour is adjacent to an LED having the second colour.

Other preferred features and advantages of the invention will be apparent from the appended claims.

The present invention also provides a combined lighting and speaker device having a central longitudinal axis defining a forward and a rearward direction and a radially outward and a radially inward direction. The combined lighting and speaker device comprises: a ring tweeter; a light emitting diode, LED, chip and lens assembly positioned radially inwardly of the ring tweeter; a tweeter horn positioned radially outwardly of the ring tweeter, a speaker positioned rearward of the tweeter horn. The tweeter horn has an inner edge in communication with an outer edge of the tweeter, so that the tweeter horn forms a guide to direct sound produced by the tweeter away from the speaker when in use.

As with the first embodiment, providing a tweeter cone directs HF sound from the tweeter away from the LF speaker. Advantageously, interference of the HF sound with the LF speaker is reduced by the presence of the horn.

The lens may be configured such that the light is a lambertian source or directed as a spot. In conjunction with this, fresnel features on the lens could be used to direct the spot by rotating the lens, rather than changing the angle of the light source itself. Alternatively, the lens may be a conventional lens. The lens may be configured so that the combined lighting and speaker device provides a more directional light source (for example, for task lighting).

BRIEF DESCRIPTION OF THE SEVERAL VIEWS OF THE DRAWINGS

The present invention may be put into practice in a number of ways, and some specific embodiments will now be described by way of example only and with reference to the following drawings.

The axes of the plots provided in FIGS. 4*b*, 5*b*, 6*b* and 8 are dB (vertical axis) against Frequency (Hz) (Horizontal axis).

Figure 5A:
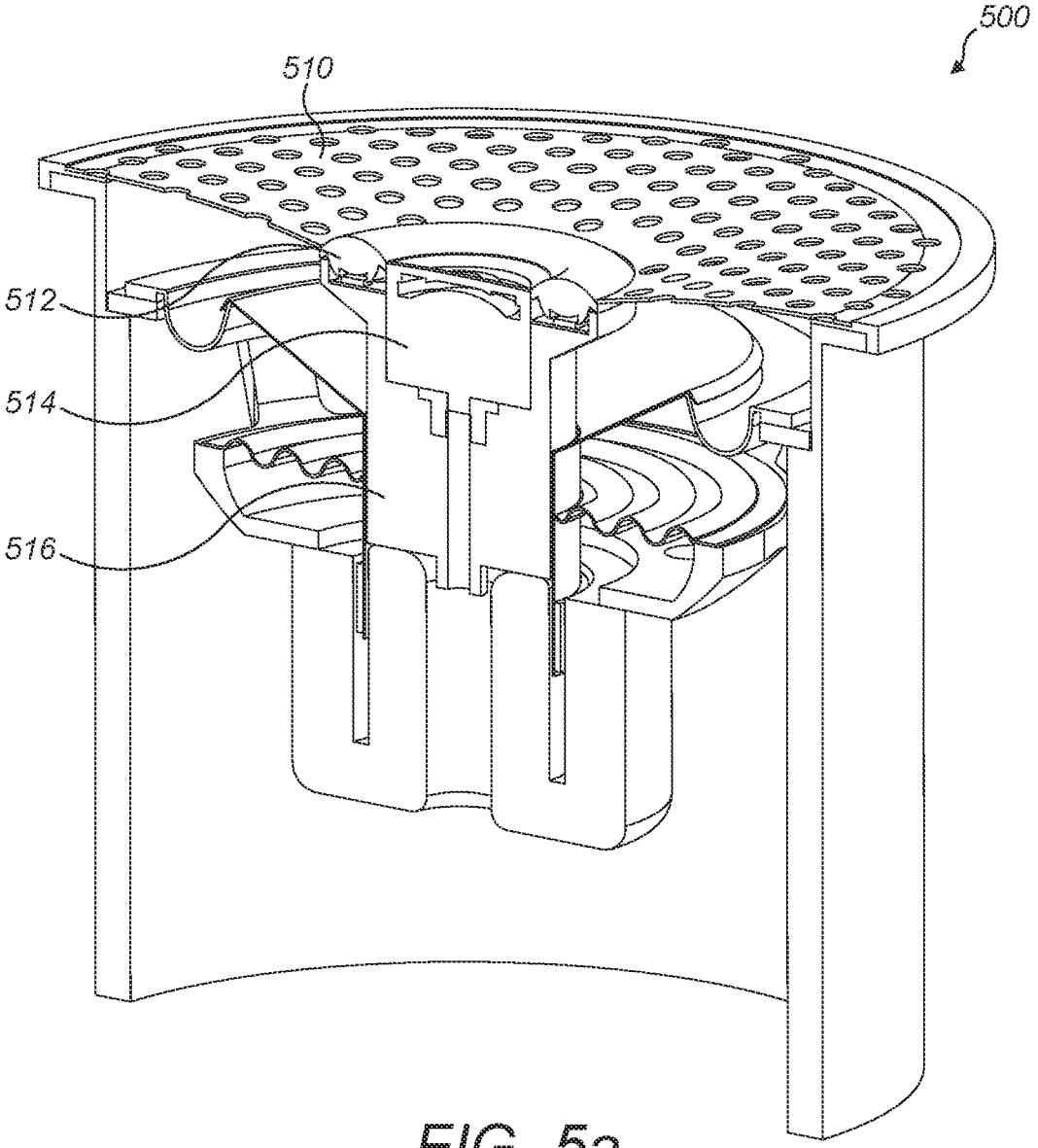
Figure 5B:
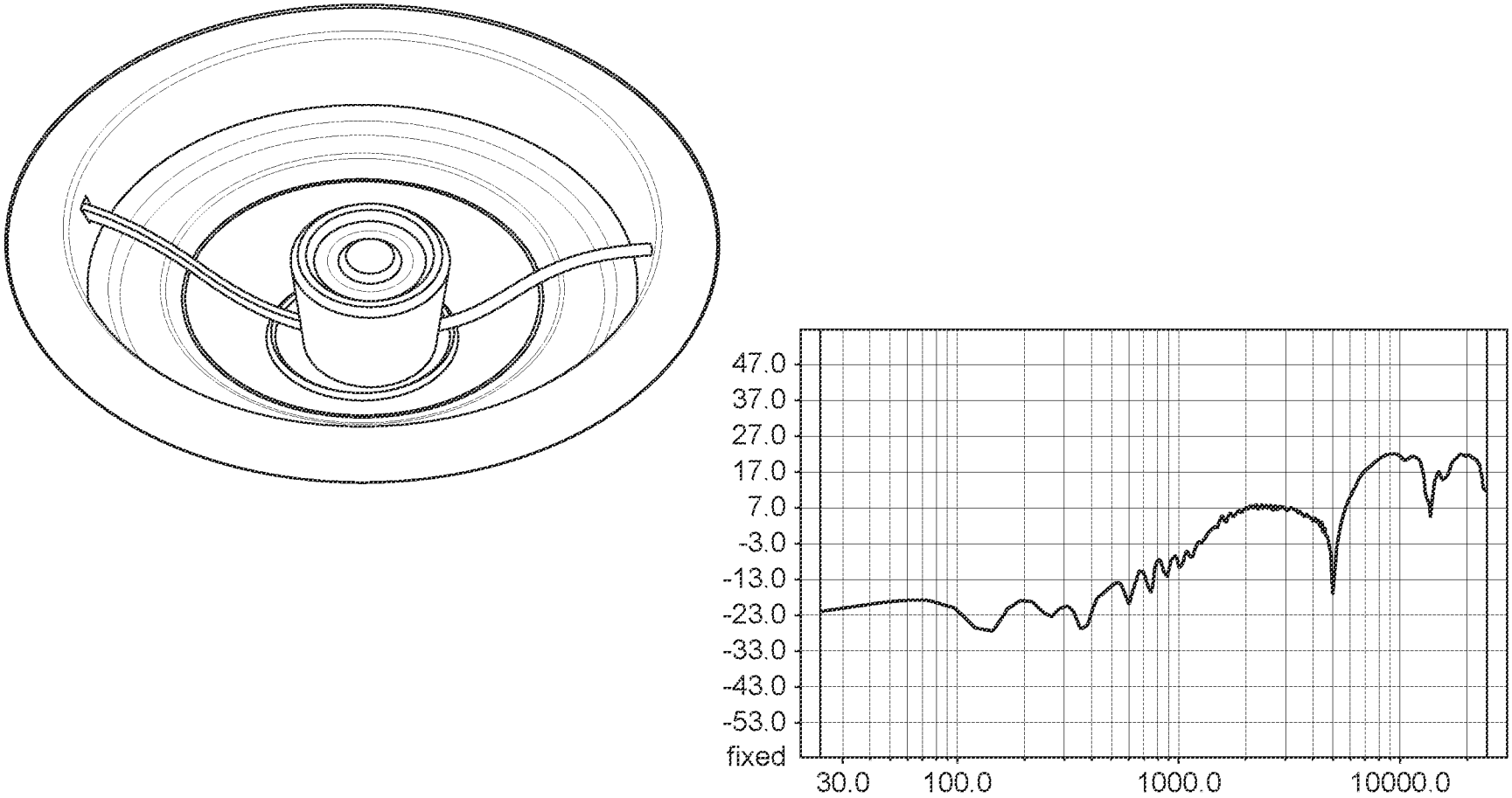

FIG. 5*a* shows a sectional view of a second example lighting and loudspeaker device. FIG. 5*b* shows a prototype device including a tweeter and LED arrangement on a stem and a plot of the results of testing the prototype device.

Figure 6A:
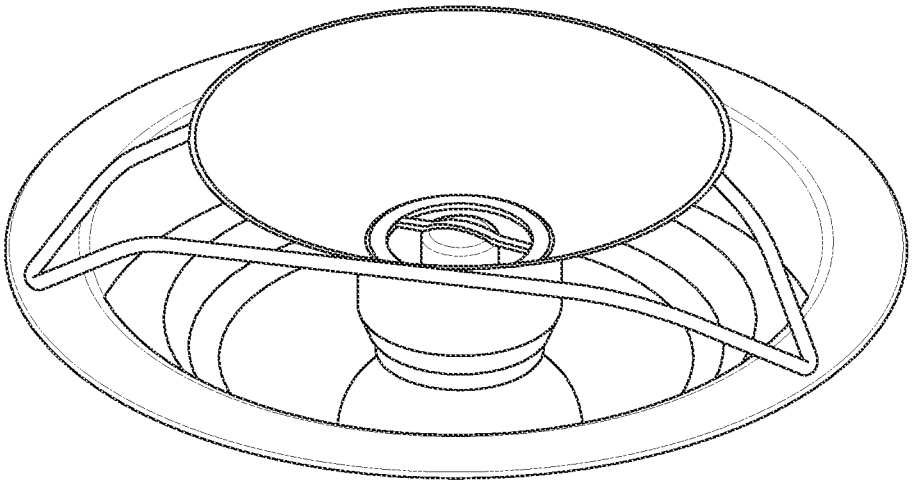
Figure 6B:
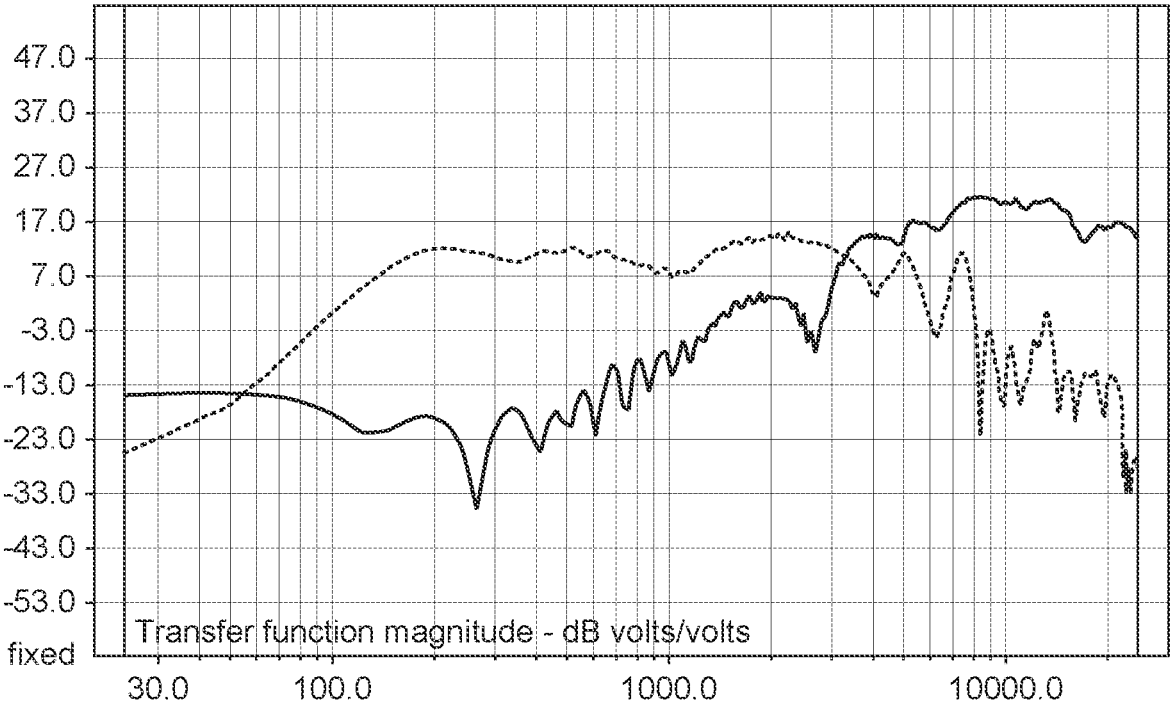

FIG. 6*a* shows a prototype device including a tweeter horn. FIG. 6*b* shows a plot of the results of testing the prototype device of FIG. 6*a*.

Figure 7A:
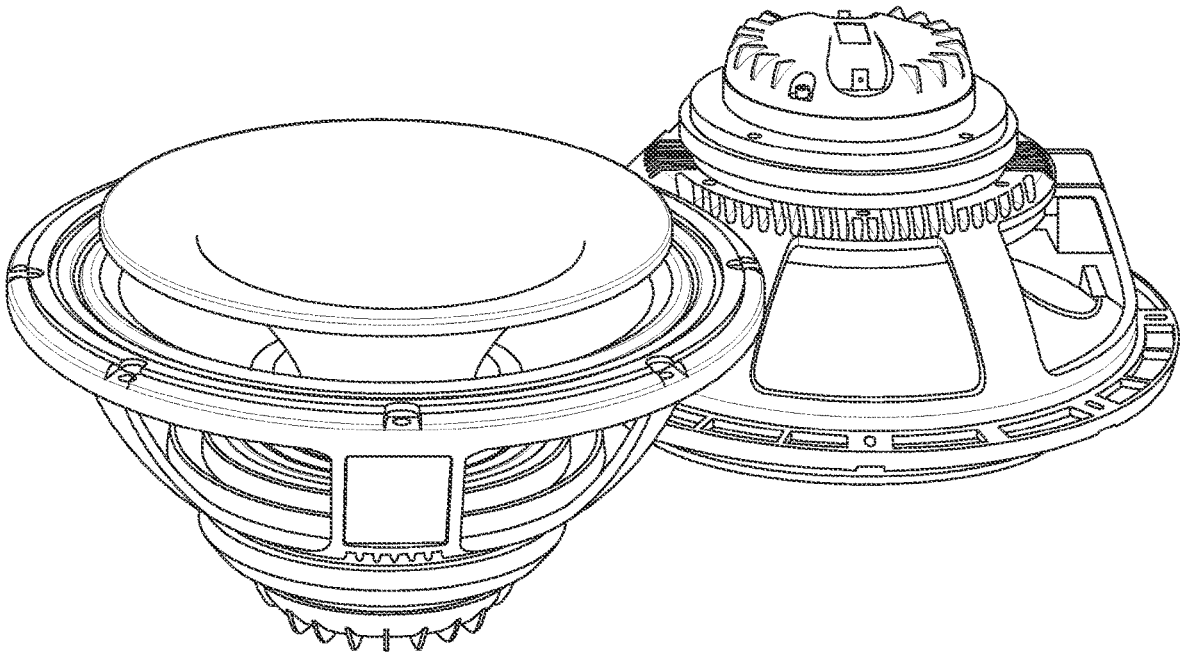
Figure 7B:
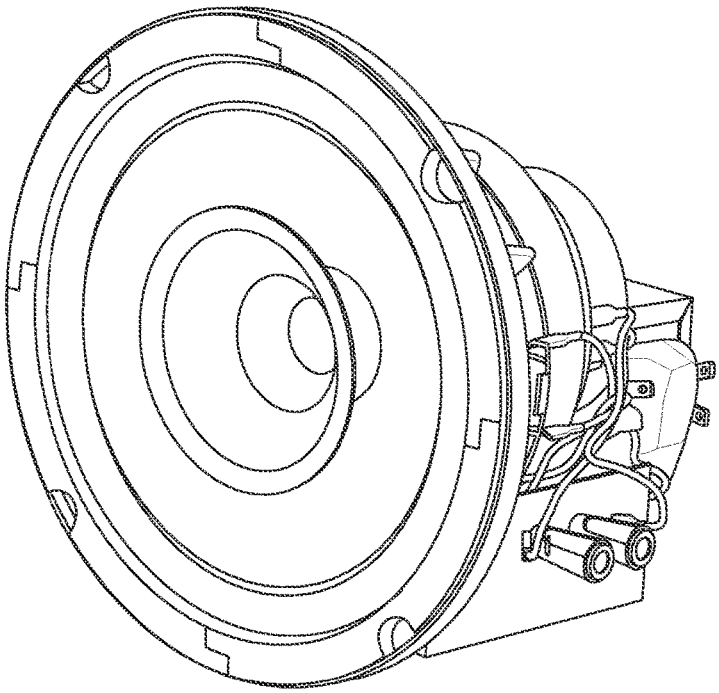

FIGS. 7*a* and 7*b* show various prior art coaxial type speaker designs.

Figure 8:
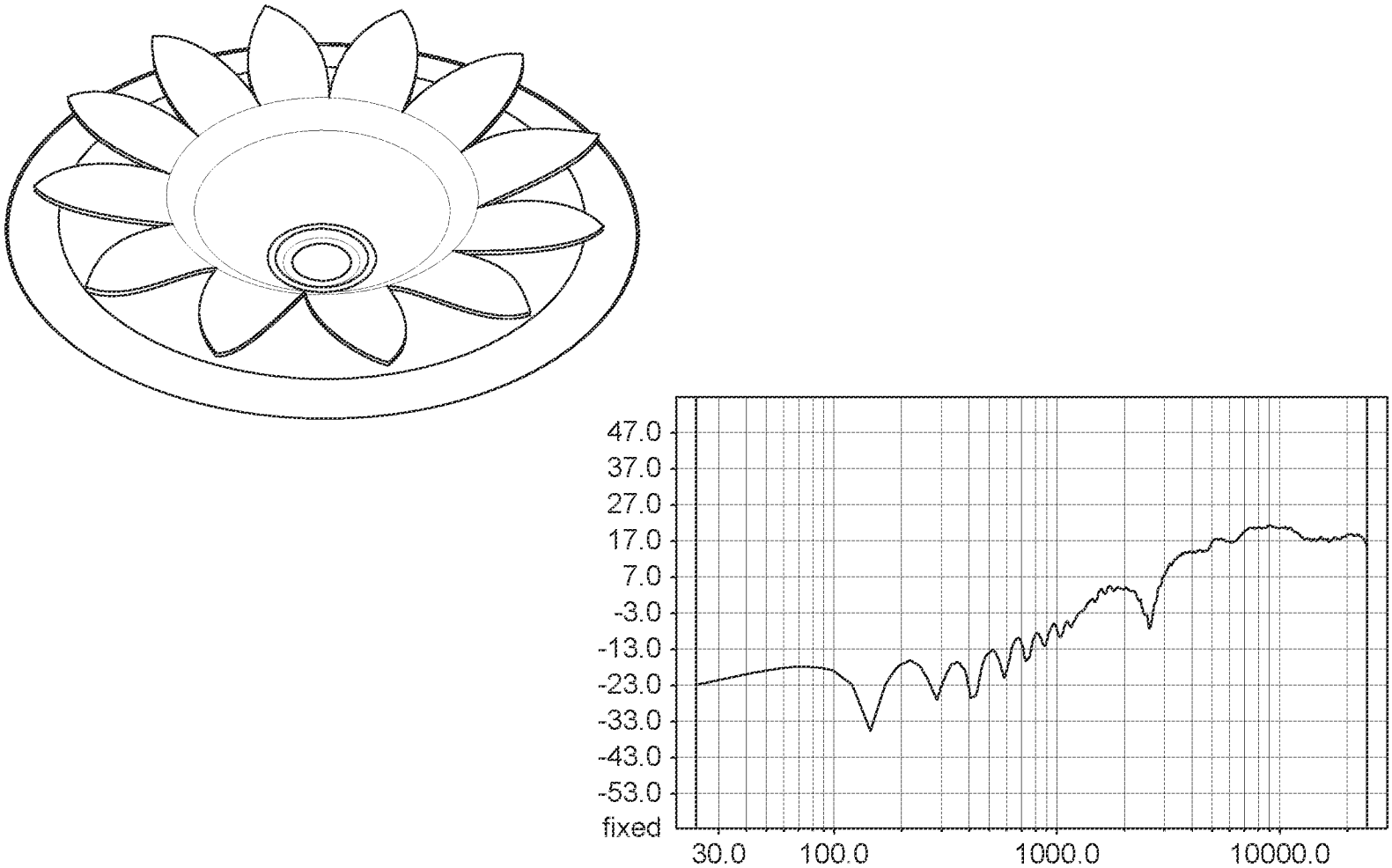

FIG. 8 shows a prototype device including a tweeter horn with the addition of "feathering" to the edge of the tweeter horn and a plot of the results of testing the prototype device.

Figure 9A:
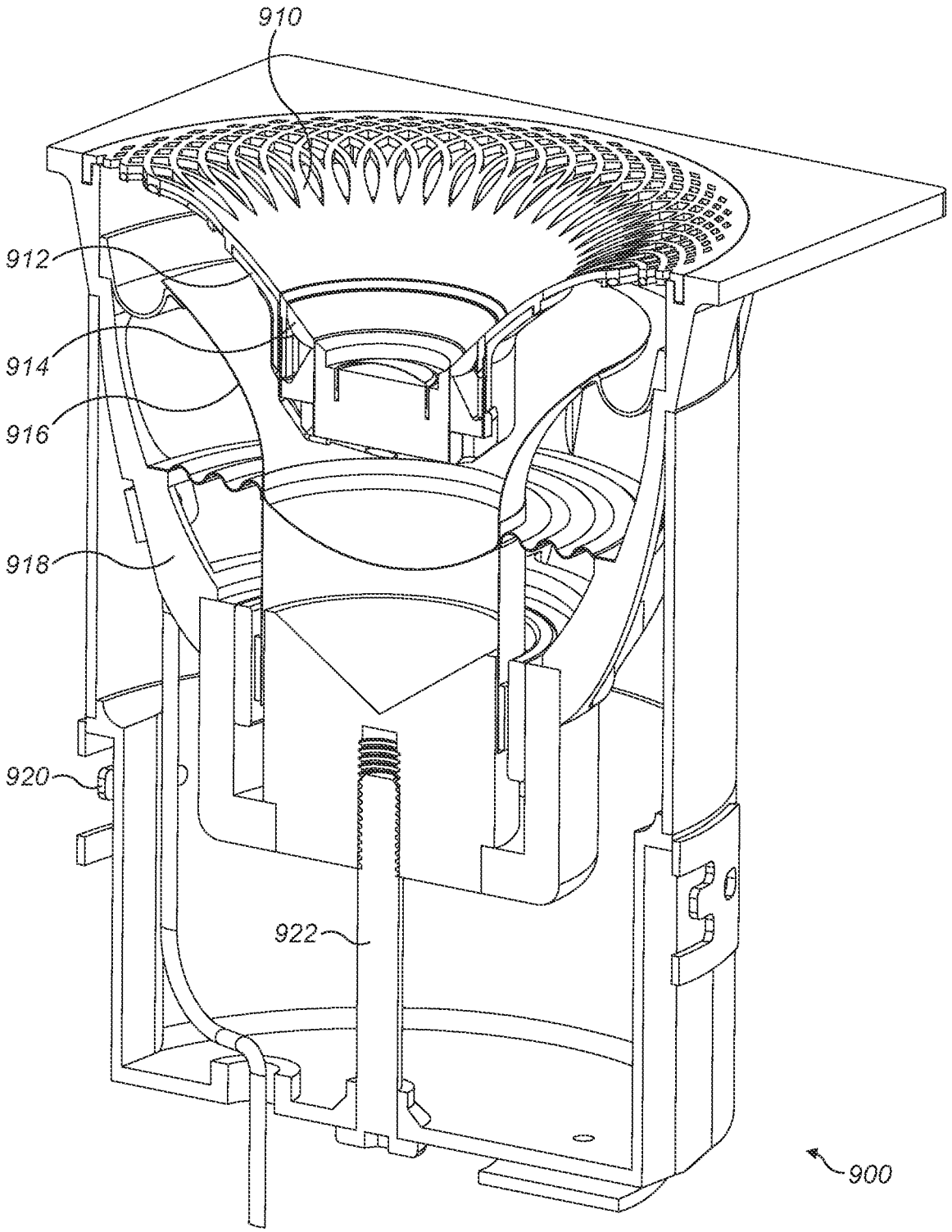
Figure 9B:
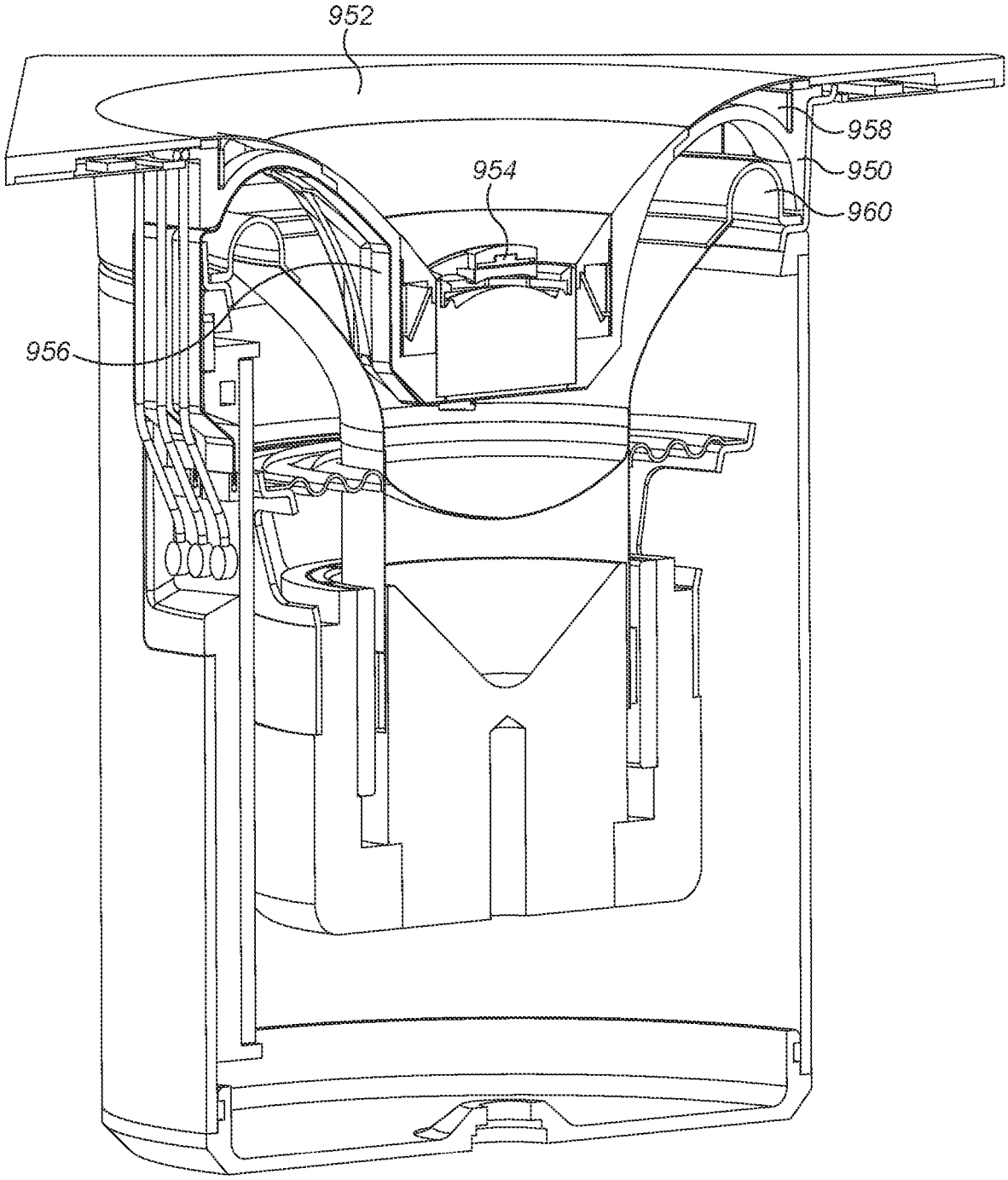

FIGS. 9*a* and 9*b* show a sectional views of a first specific embodiment of the present invention.

Figure 10:
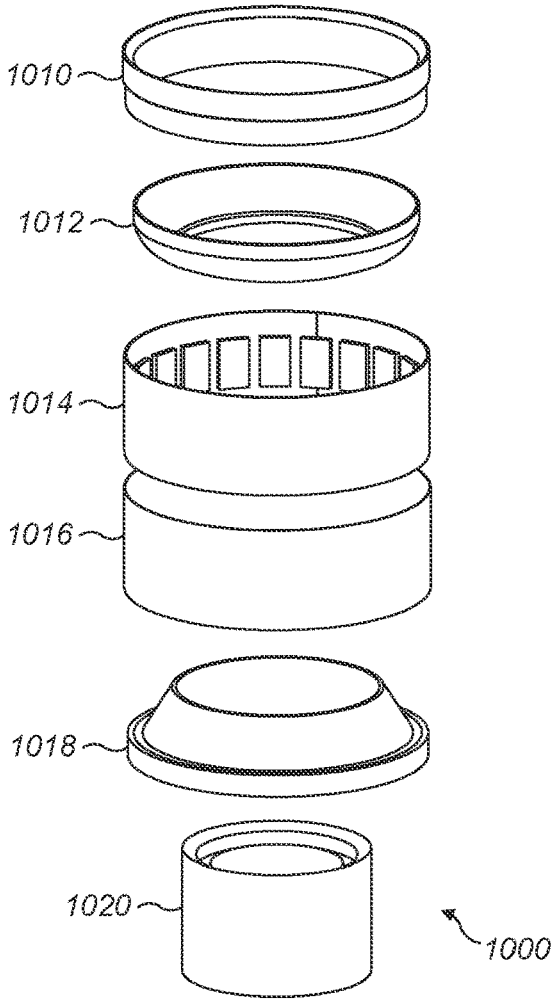

FIG. 10 shows an exploded view of an LED assembly according to a second specific embodiment of the present invention.

Figure 11:
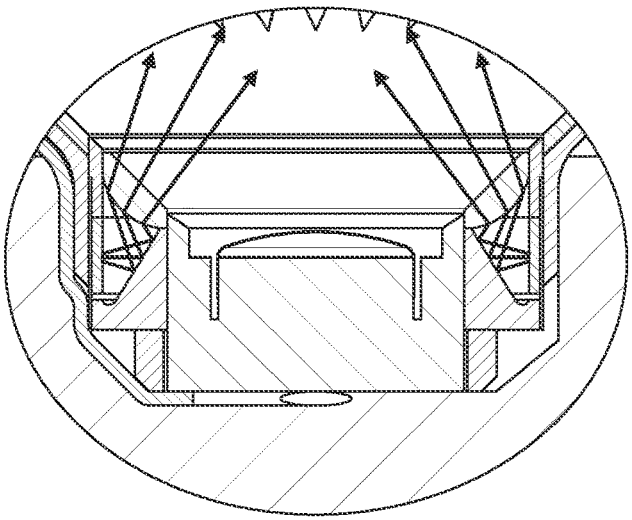

FIG. 11 illustrates some example light paths during operation of an LED assembly according to the second specific embodiment.

Figure 12:
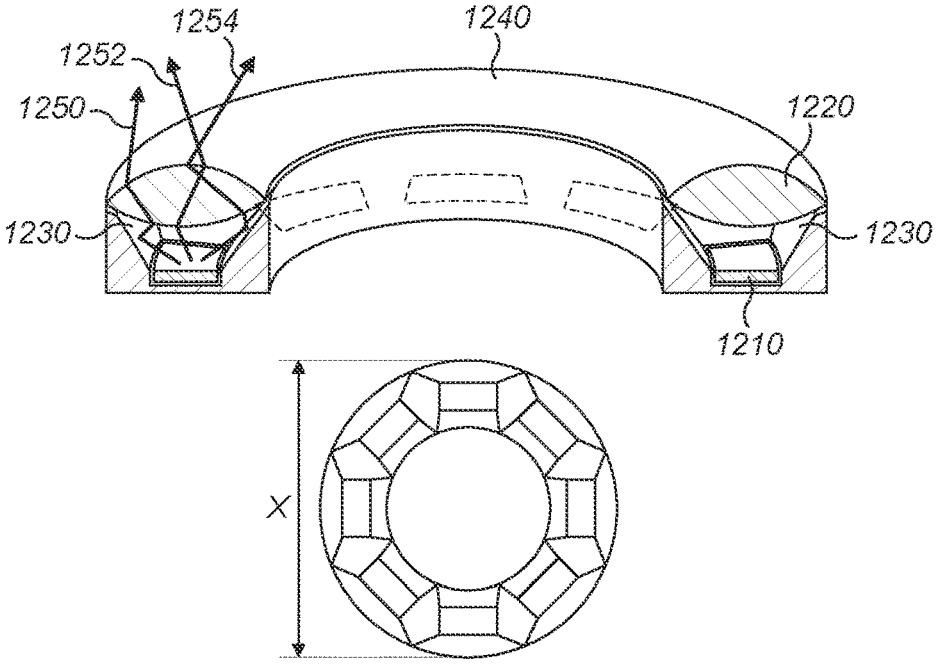

FIG. 12 shows a sectional perspective view and a plan view of an LED assembly with LEDs mounted horizontally.

Figure 13:
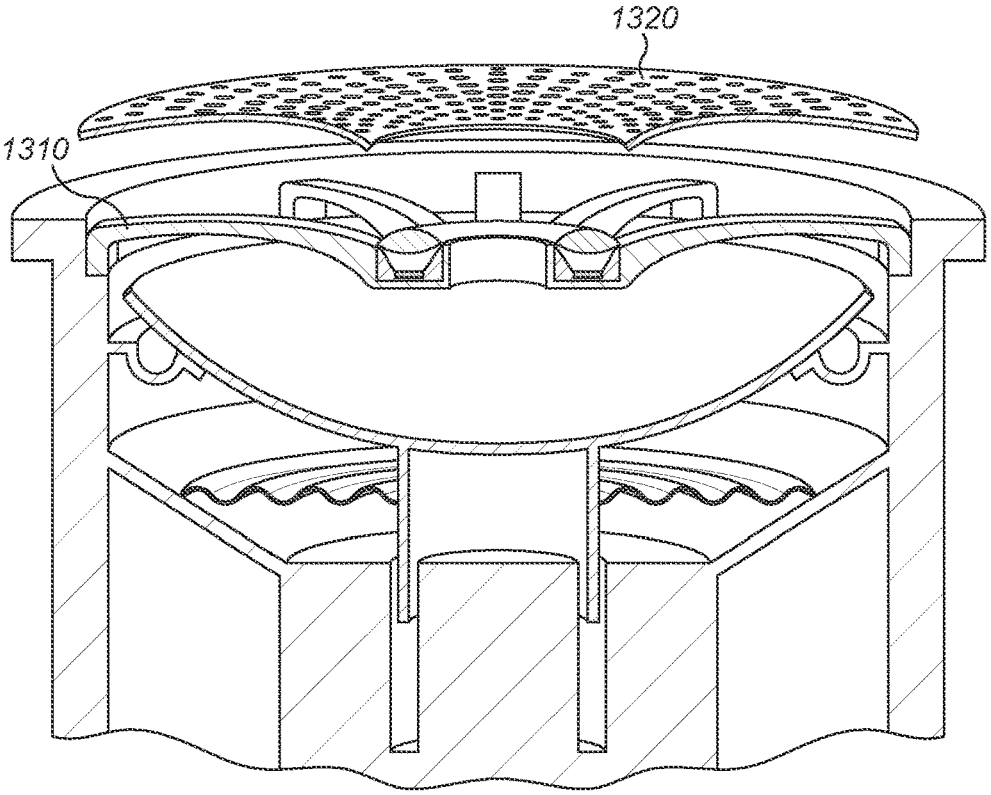

FIG. 13 shows an exploded sectional view of a horizontal LED ring assembly in a combined lighting and speaker system.

Figure 14:
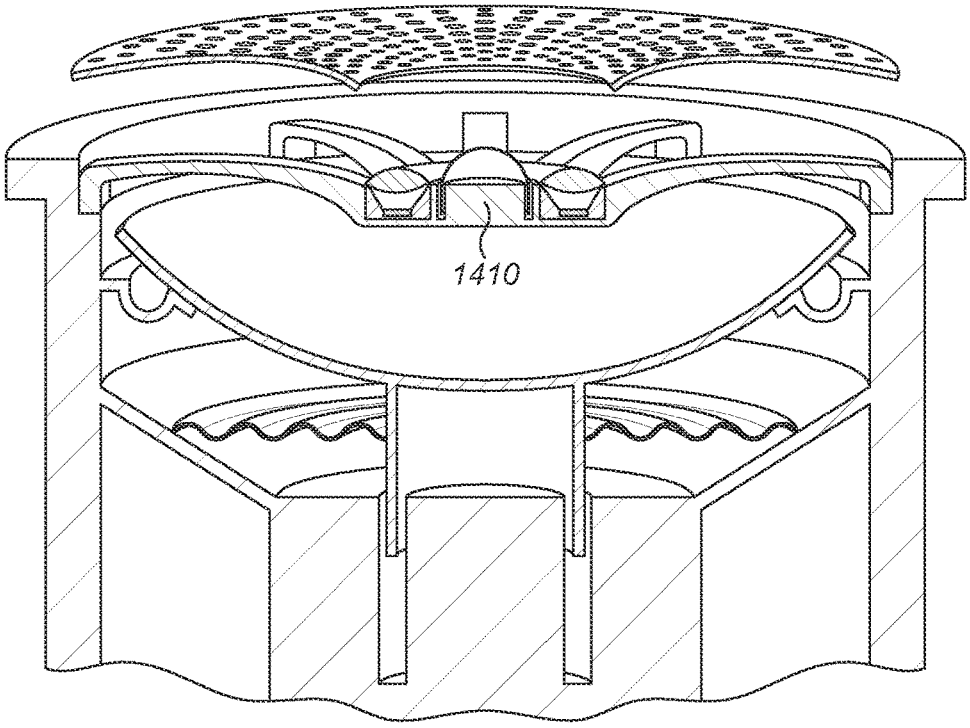

FIG. 14 shows an exploded sectional view of another example.

Figure 15:
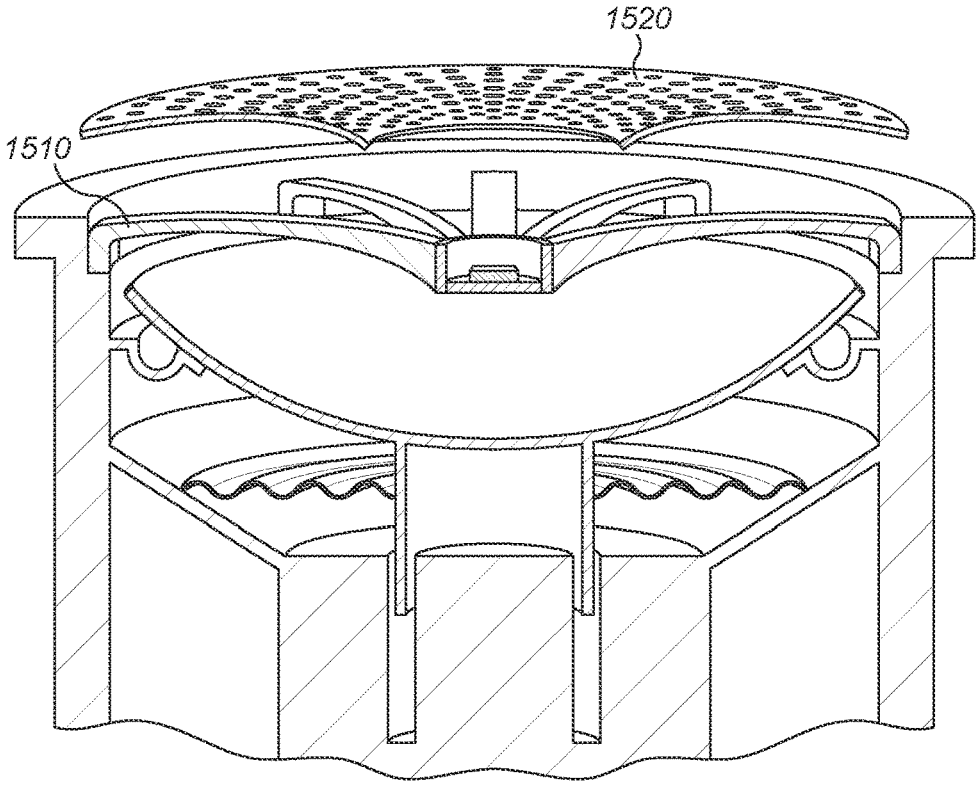

FIG. 15 shows an exploded sectional view of an alternative example.

Figure 16A:
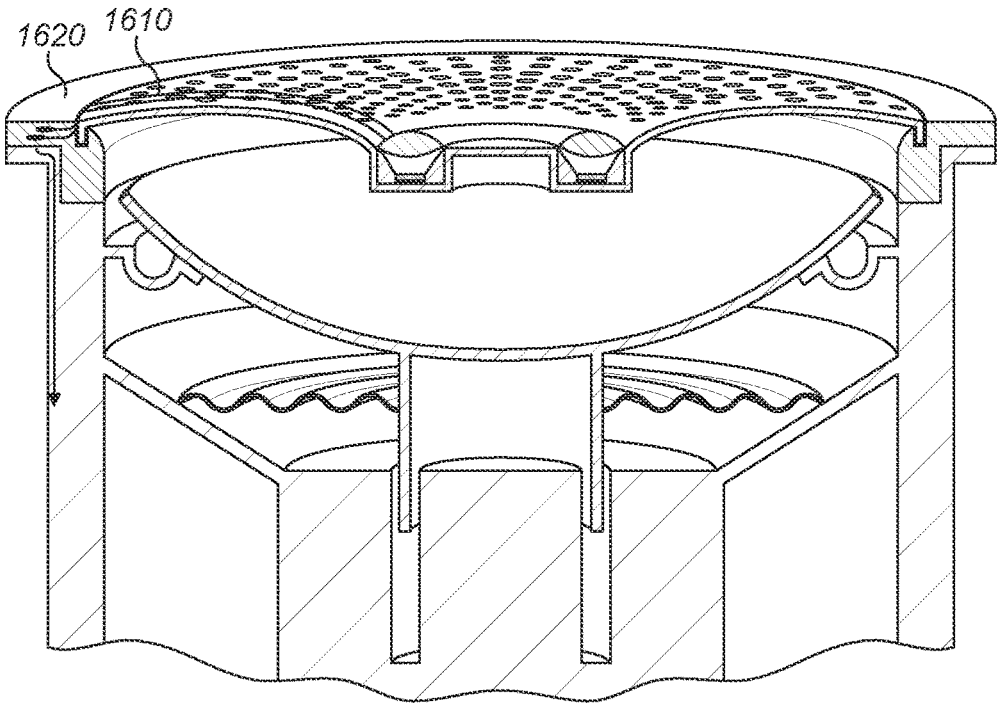
Figure 16B:
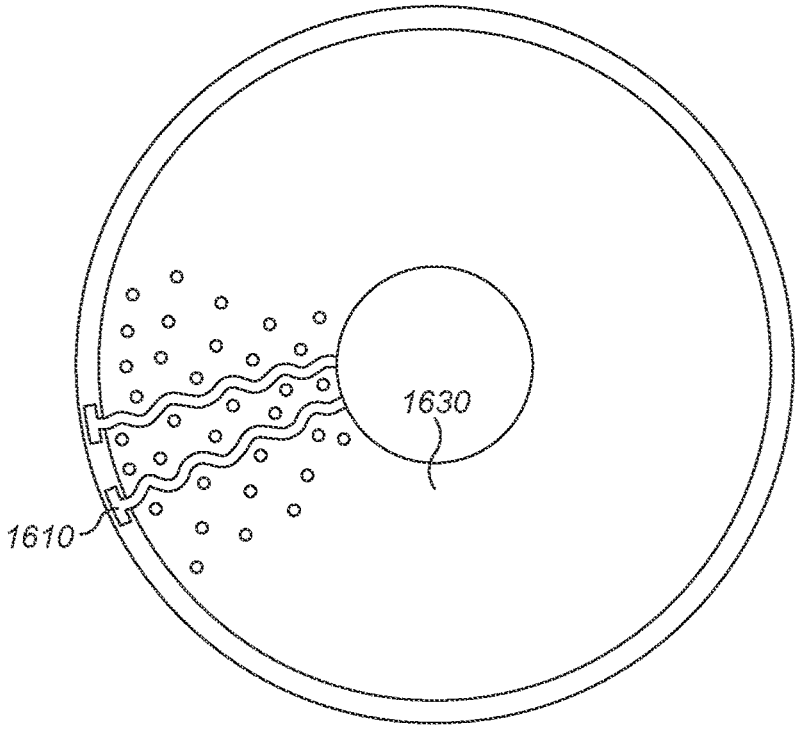

FIG. 16*a* shows a sectional view of another example. FIG. 16*b* shows the example in plan view.

Figure 17:
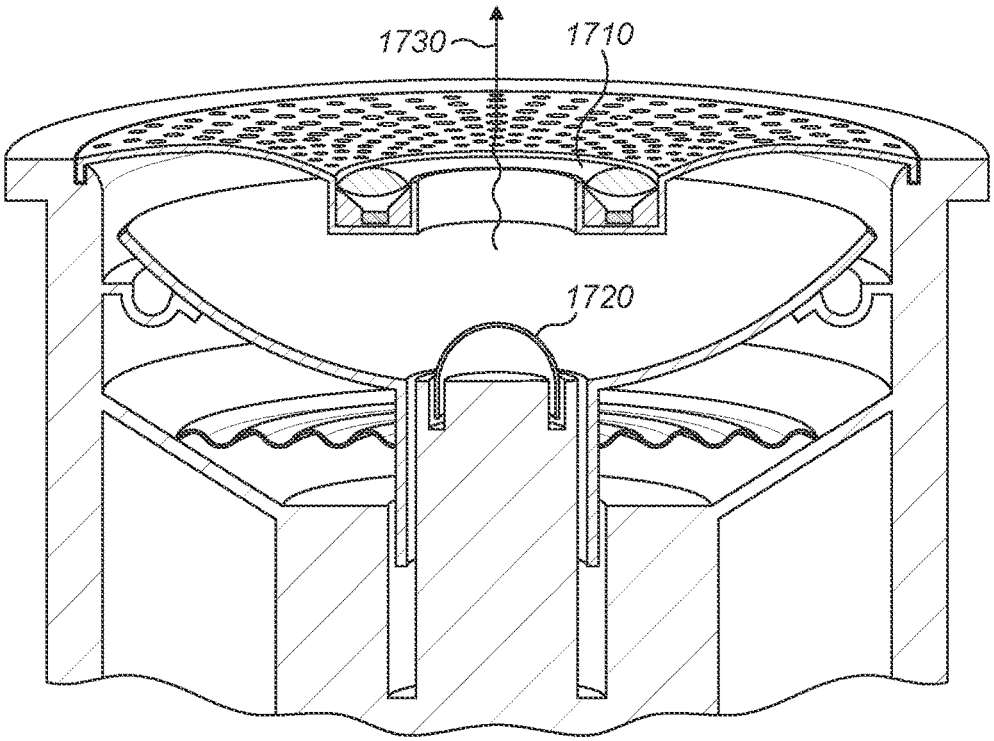

FIG. 17 shows a sectional view of another example light and loudspeaker device.

Figure 18:
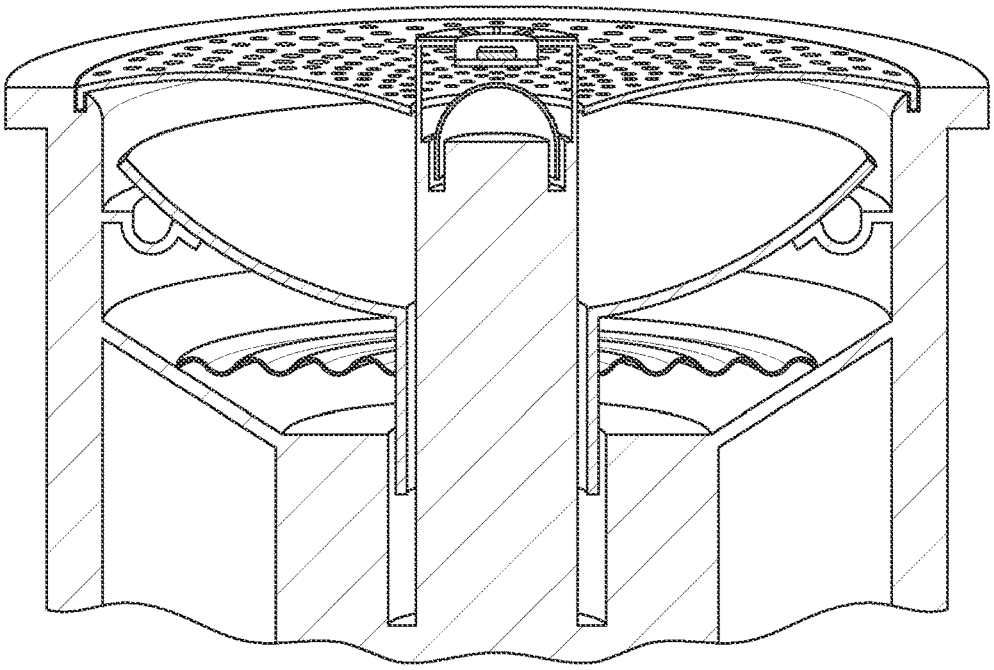

FIG. 18 shows a sectional view of a further example light and loudspeaker device.

Figure 19:
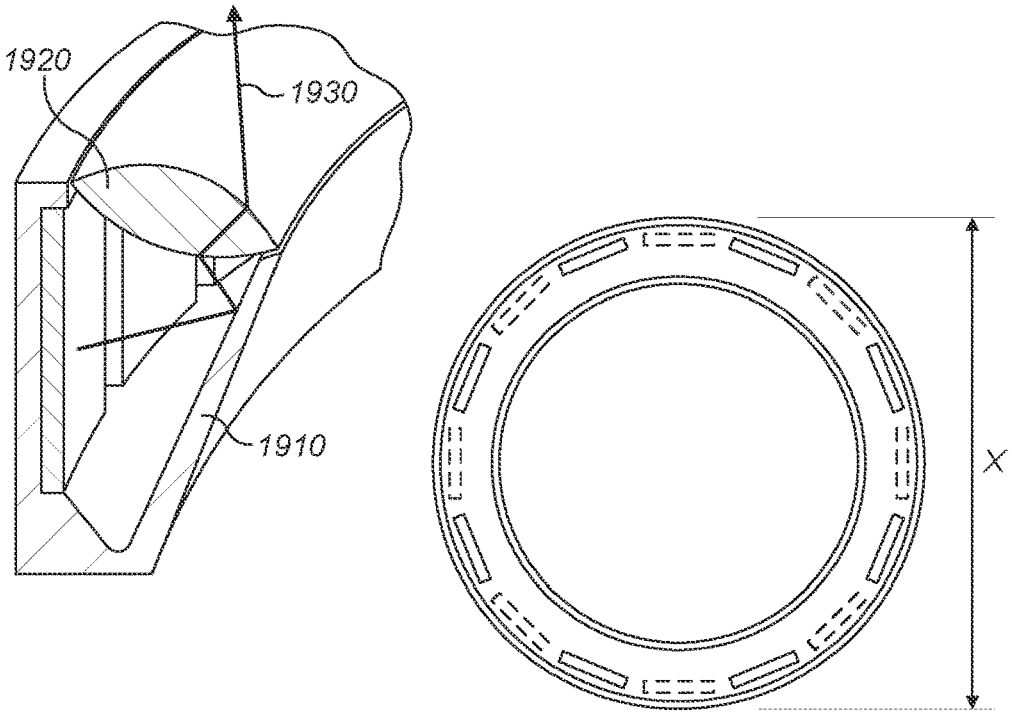

FIG. 19 shows a sectional view of an example of another combined lighting and loudspeaker device.

Figure 20:
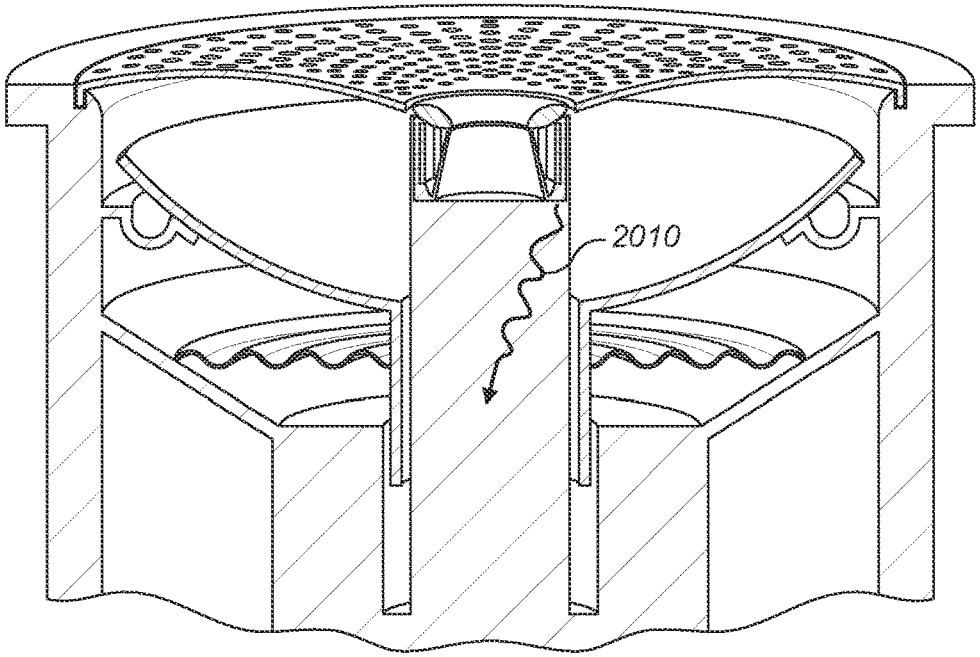

FIG. 20 shows a sectional view of another example of a combined lighting and loudspeaker device.

Figure 21:
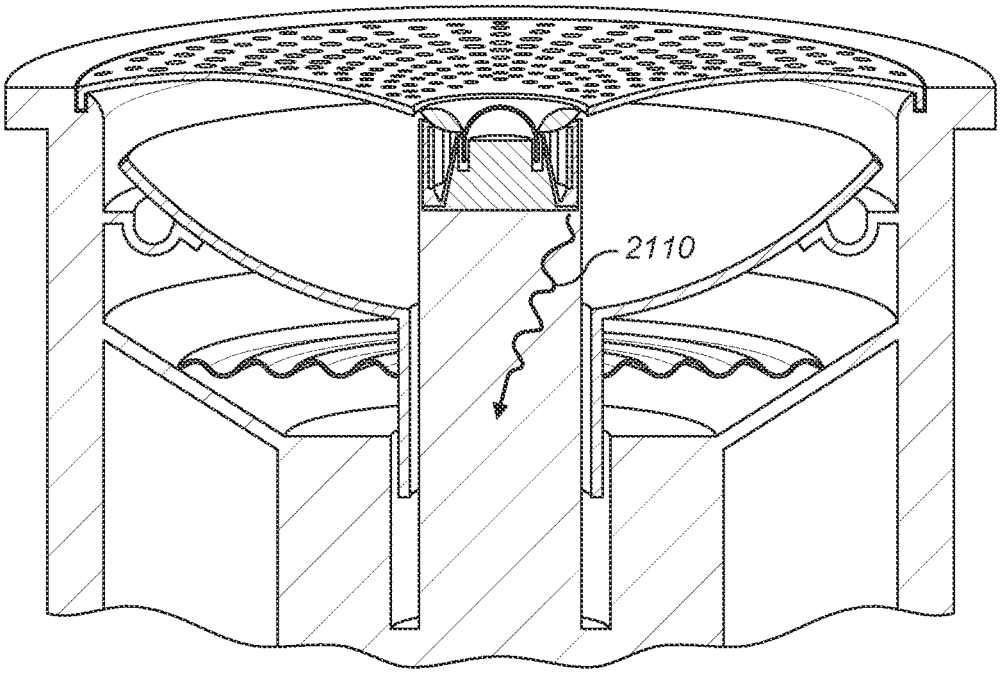

FIG. 21 shows a sectional view of another example of a combined lighting and loudspeaker device.

Figure 22:
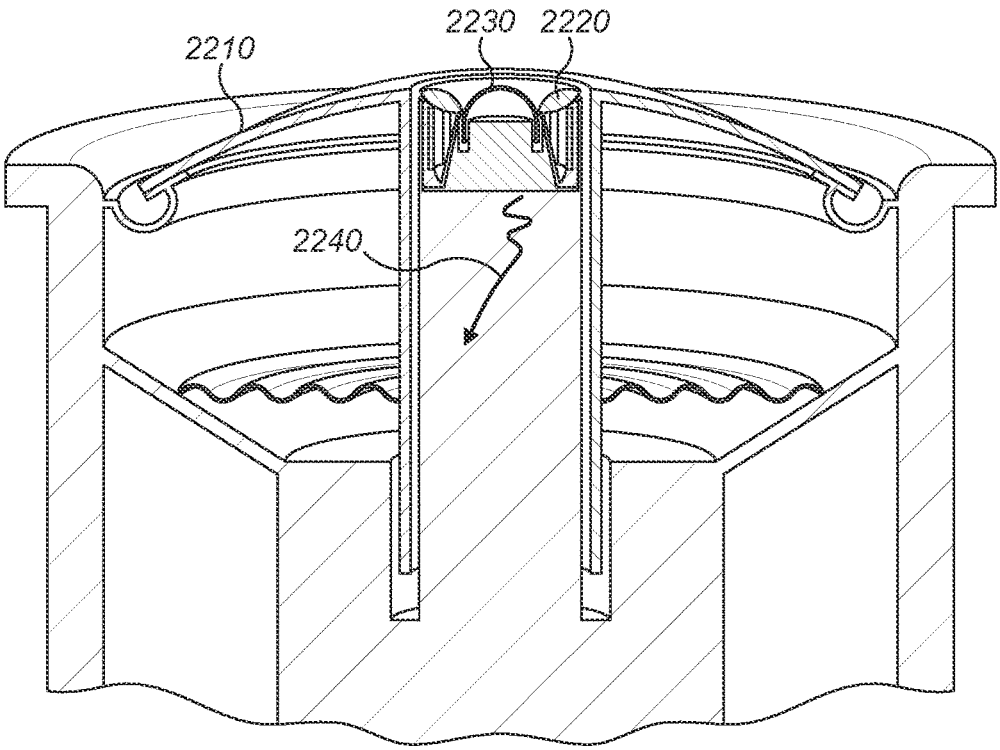

FIG. 22 shows a sectional view of another example of a combined lighting and loudspeaker device.

Figure 23:
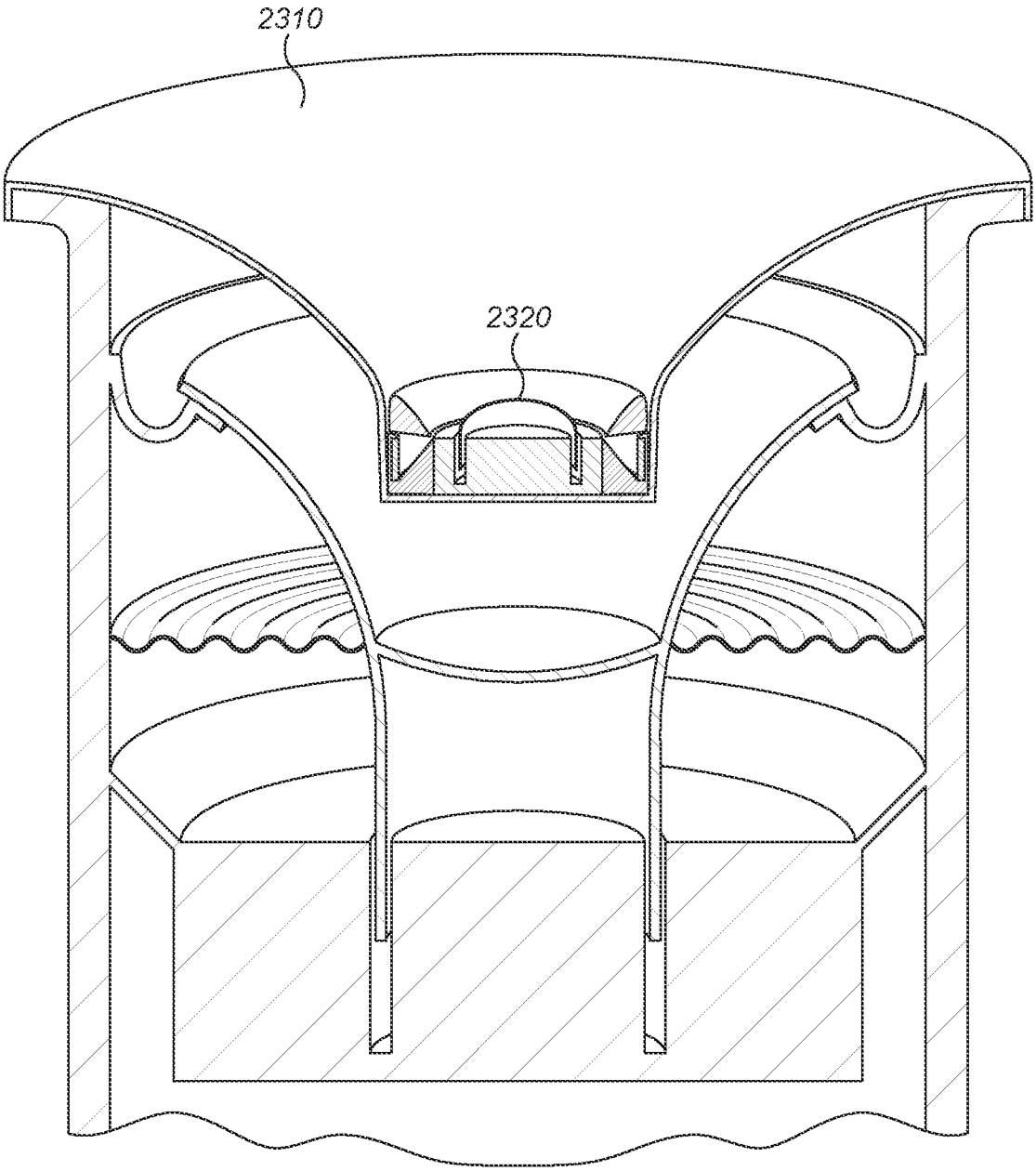

FIG. 23 shows a sectional view of another example of a combined lighting and loudspeaker device.

Figure 24:
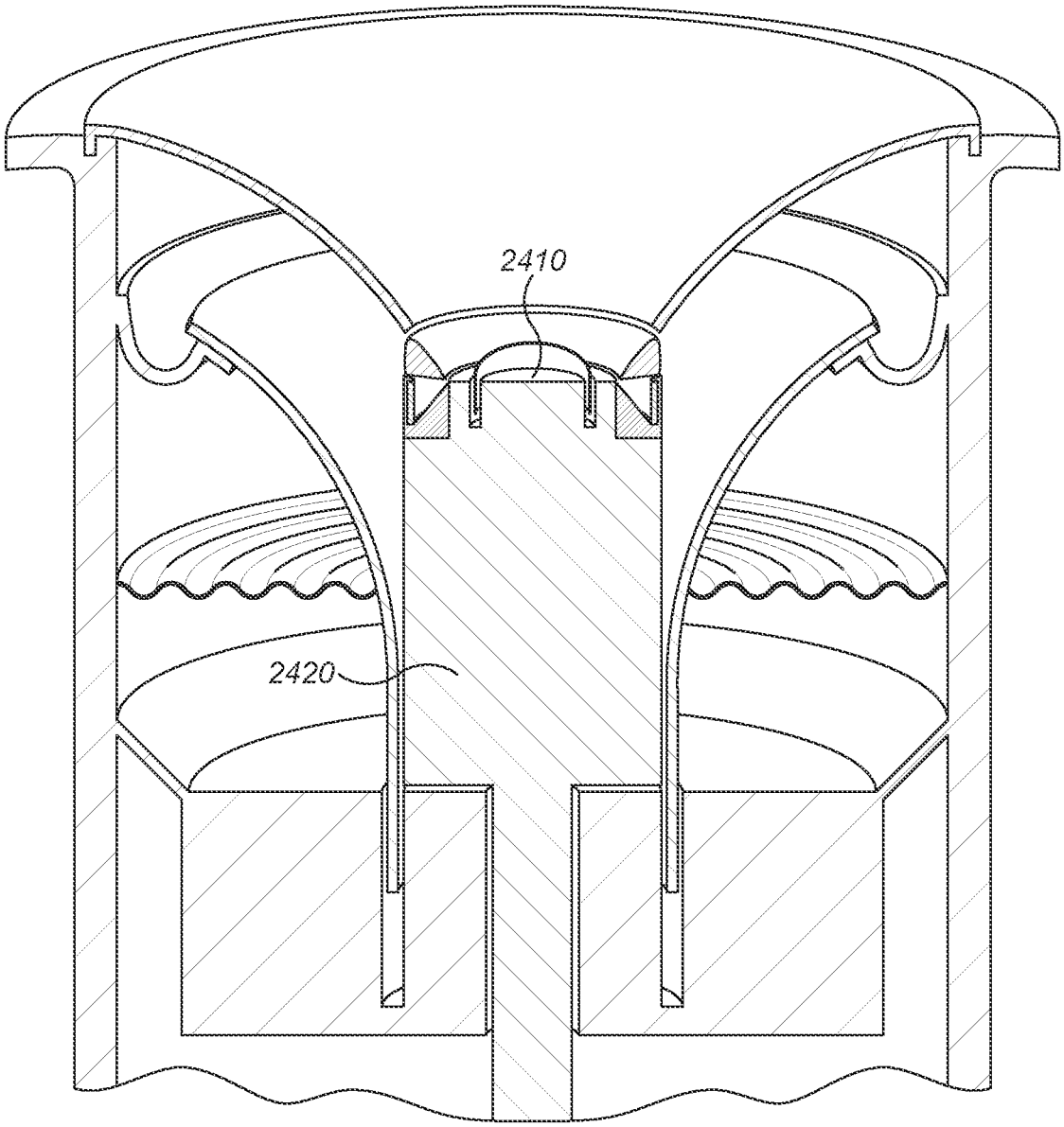

FIG. 24 shows a sectional view of another example of a combined lighting and loudspeaker device.

Figure 25:
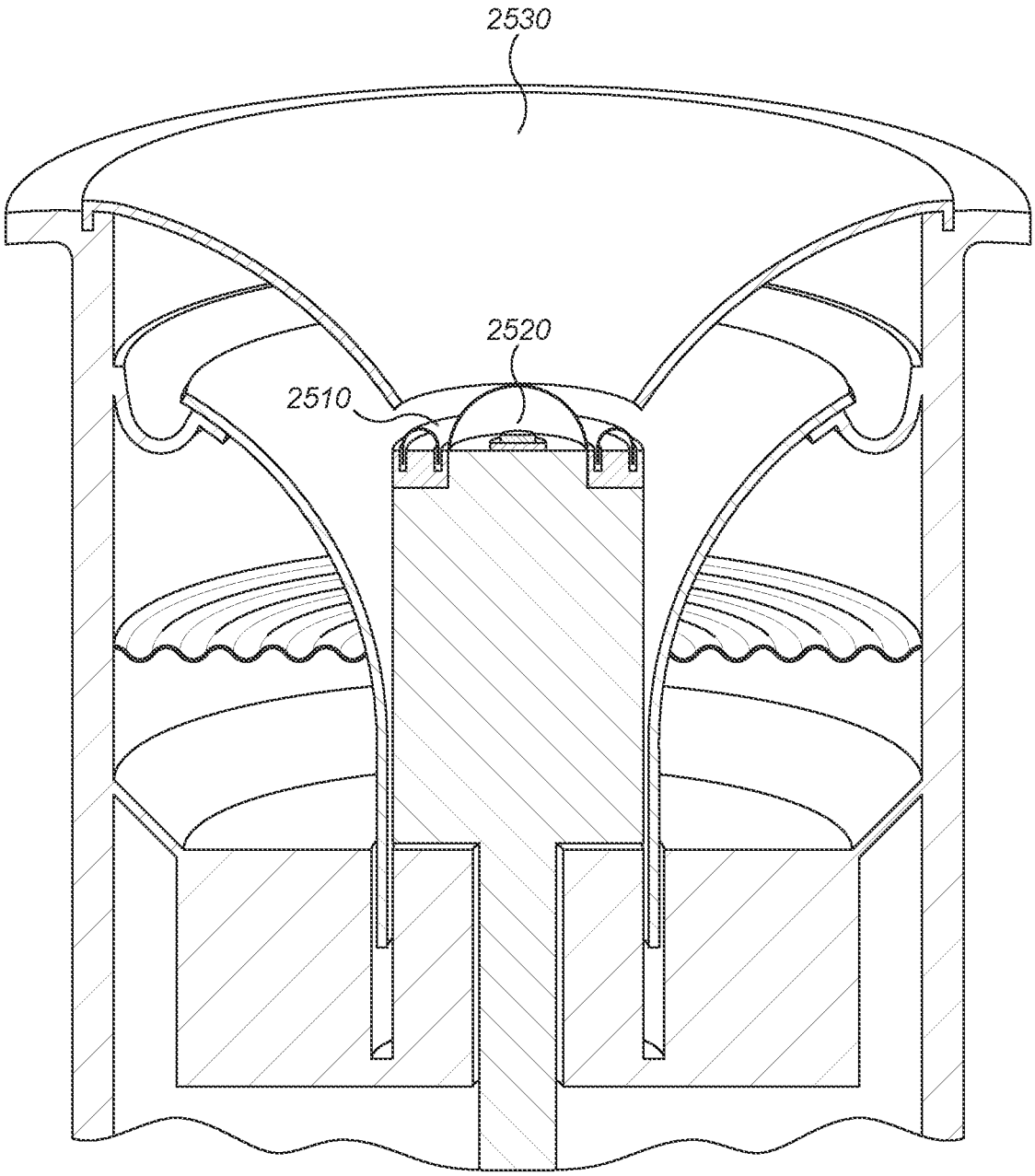

FIG. 25 shows a sectional view of another example of a combined lighting and loudspeaker device.

Figure 26:
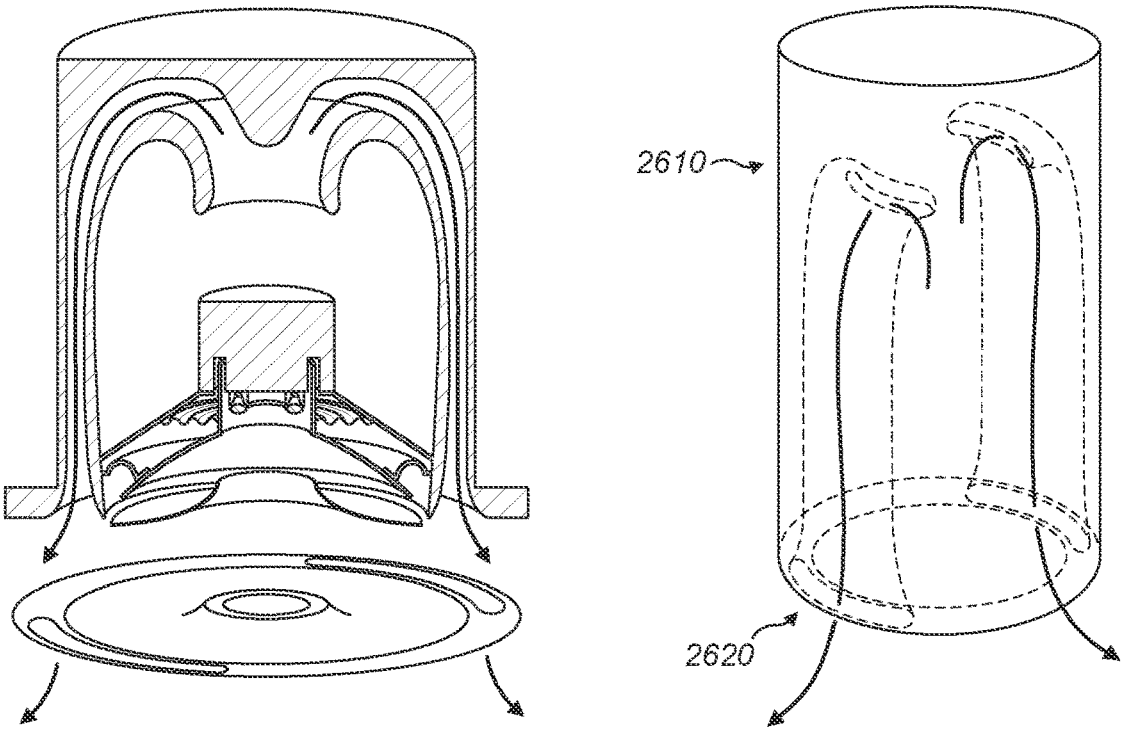

FIG. 26 shows a sectional and perspective view of a combined light and loudspeaker device that includes ports within the wall of the device.

Figure 27:
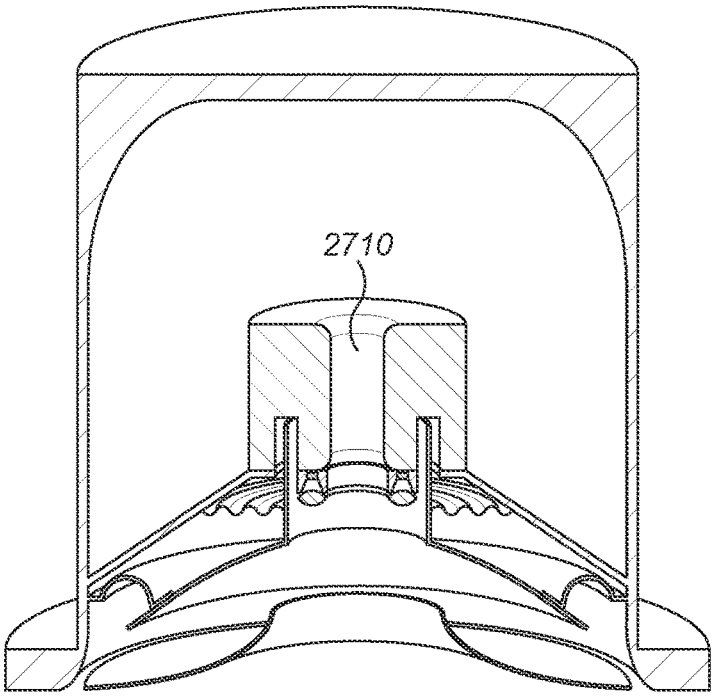

FIG. 27 shows a sectional view of an example combined light and loudspeaker device that includes a coaxial port running down the pole piece.

Figure 28:
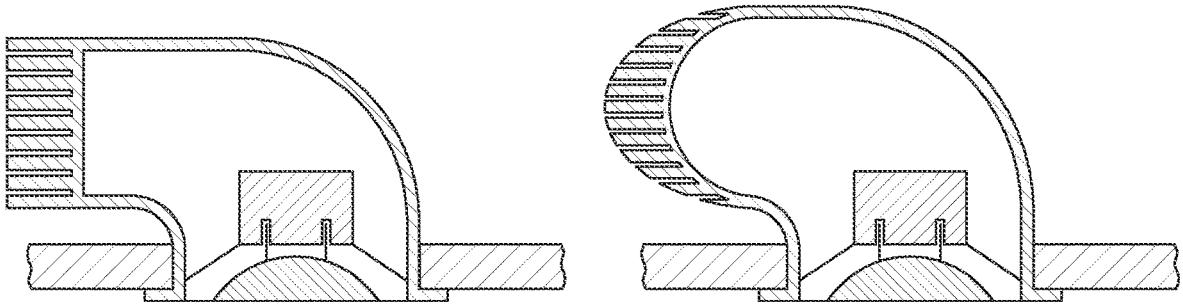

FIG. 28 shows two sectional views of example combined light and loudspeaker devices that include an elbow to increase the volume of the cavity enclosed in the device.

Figure 29:
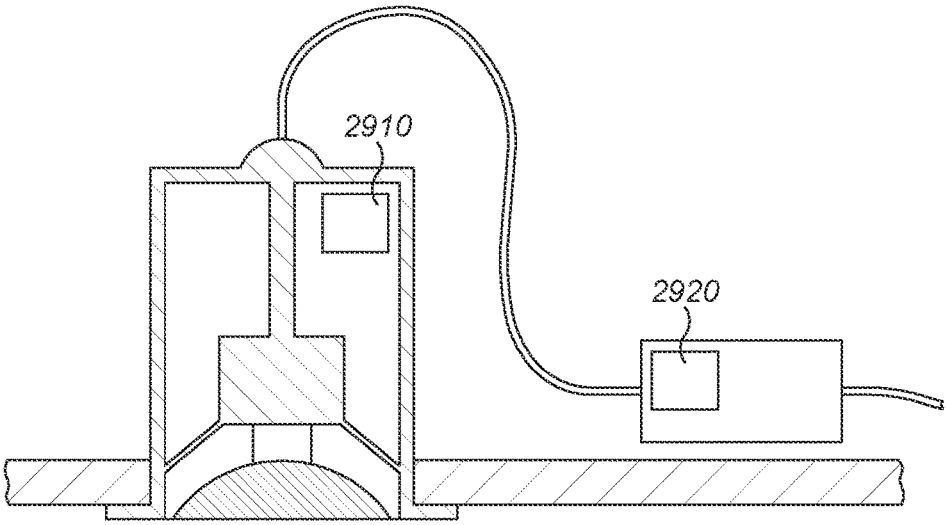

FIG. 29 shows a sectional view of an example combined light and loudspeaker device that includes a battery.

DESCRIPTION OF SPECIFIC EMBODIMENTS OF THE INVENTION

In order to obviate the need for a heat path through the centre of the voice coil, the present invention provides a larger numbers of high efficiency lower output LEDs which are collectively capable of similar lumen output but require minimal heat removal. In some examples, 8 or more LEDs are provided in the device.

According to embodiments of the present invention, a heat pipe through the centre of the voice coil is no longer needed. However, the high efficiency lower output LEDs still produce some heat, which needs to be dissipated in order to avoid damaging the LEDs. In some embodiments, a metal interface and small metal surface area are provided to remove heat.

LED Integration According to Two Examples

Figure 1:
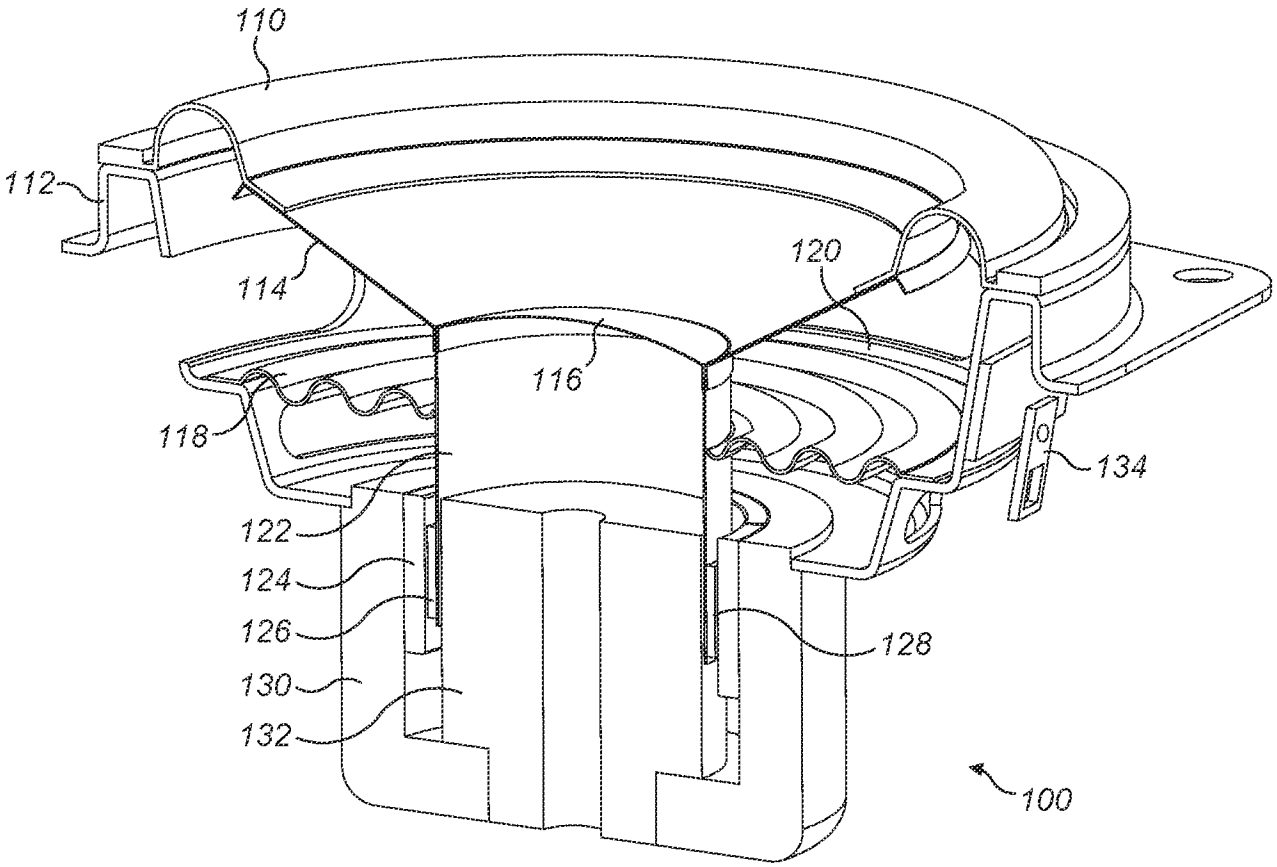
FIG. 1 (Prior Art)
FIG. 1 shows a sectional view of a known speaker device 100.
Figure 2:
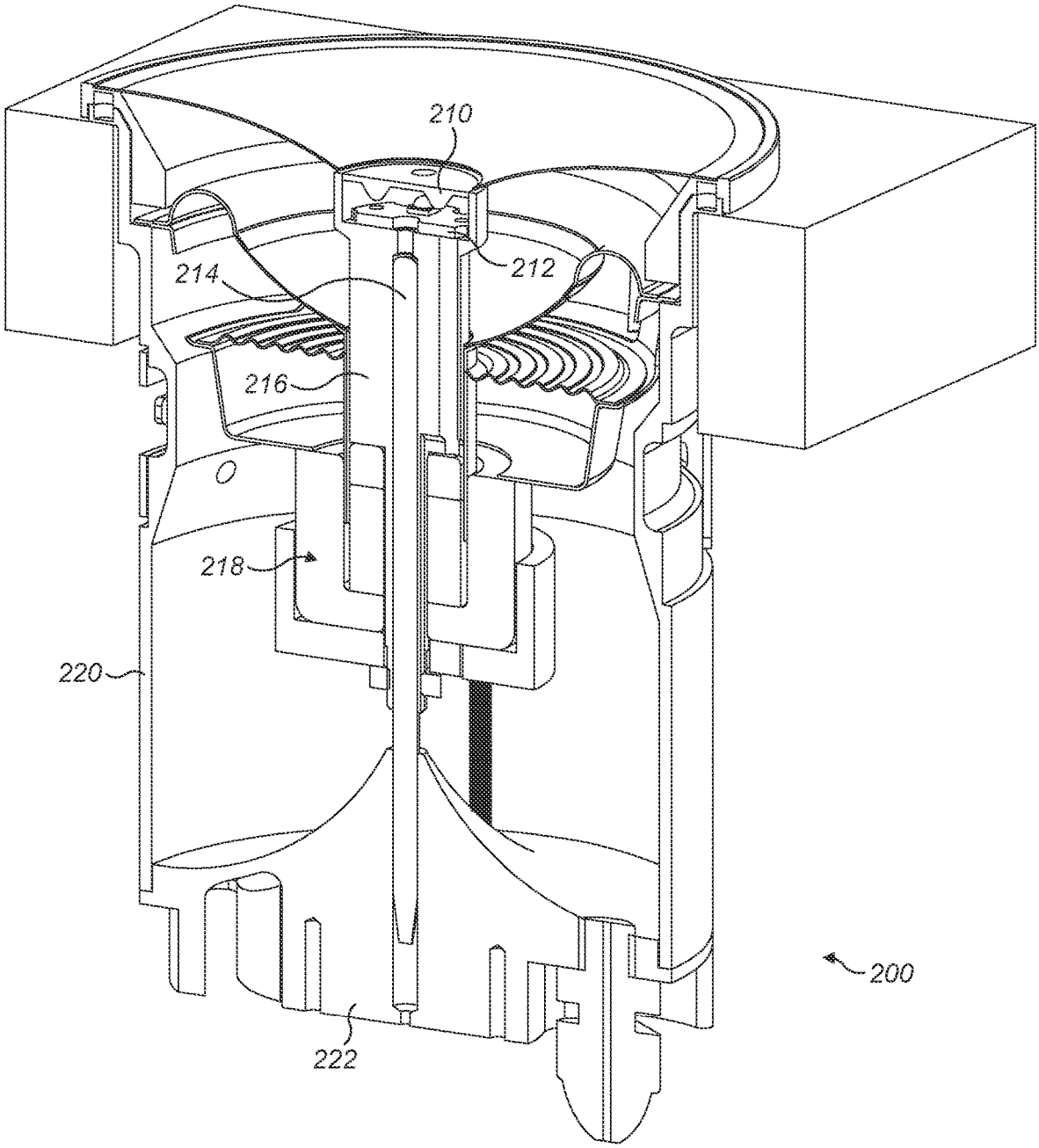
FIG. 2 (Prior Art)
FIG. 2 shows a sectional view of a combined lighting and speaker device including a single full range speaker.
Figure 3A:
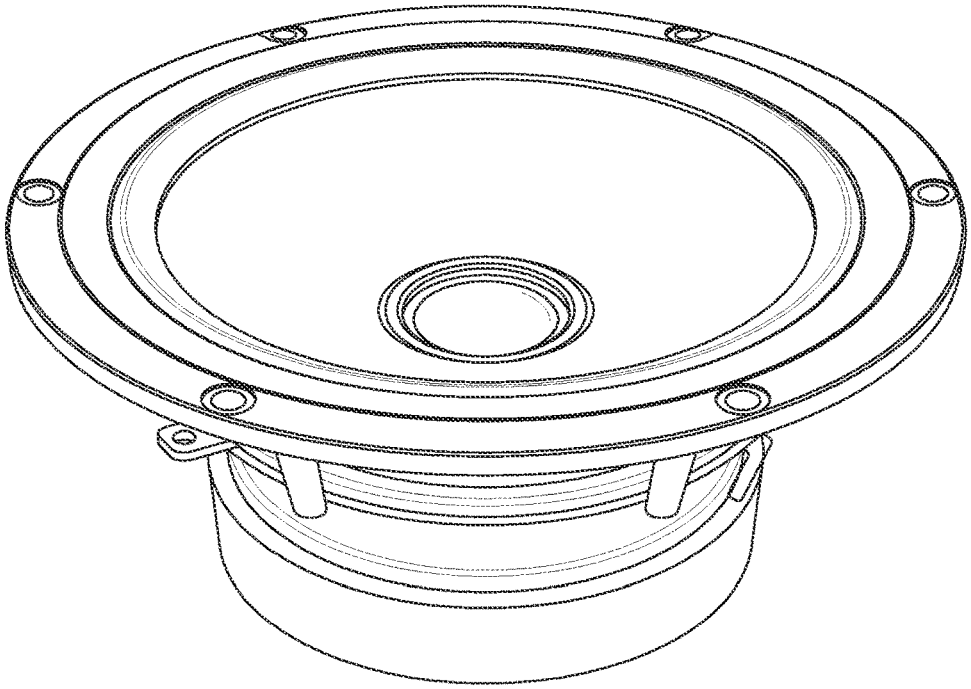
FIGS. 3*a* and 3*b* show a first possible approach to integrating a separate tweeter coaxially within a drive unit in a speaker system.
Figure 3B:
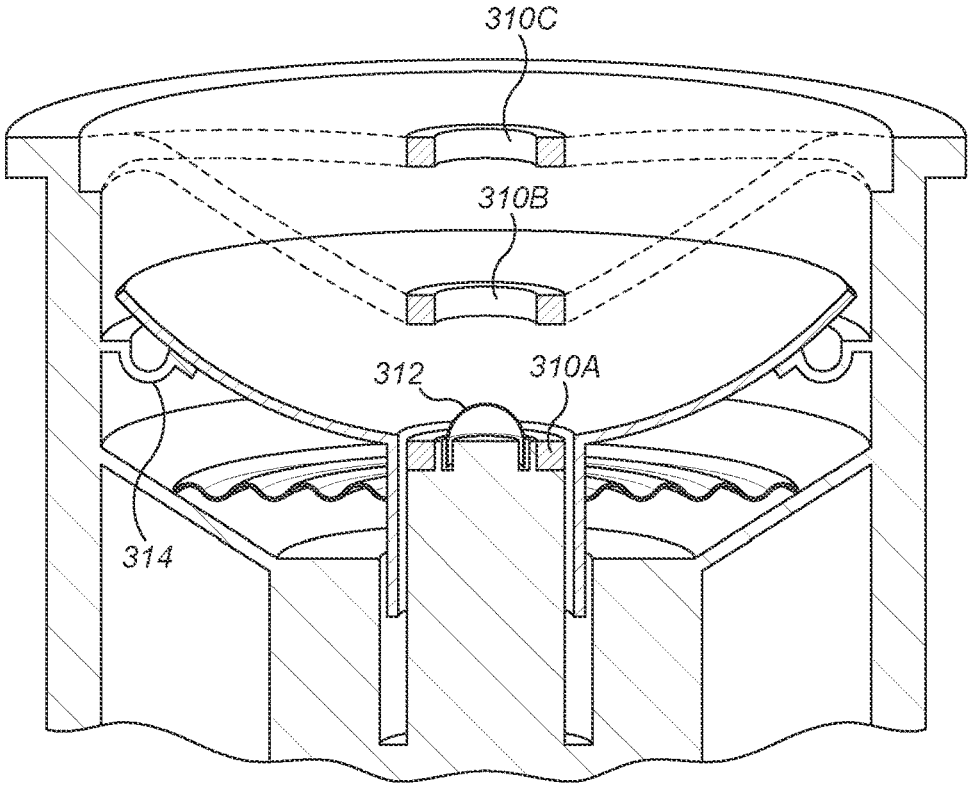
Figure 3C:
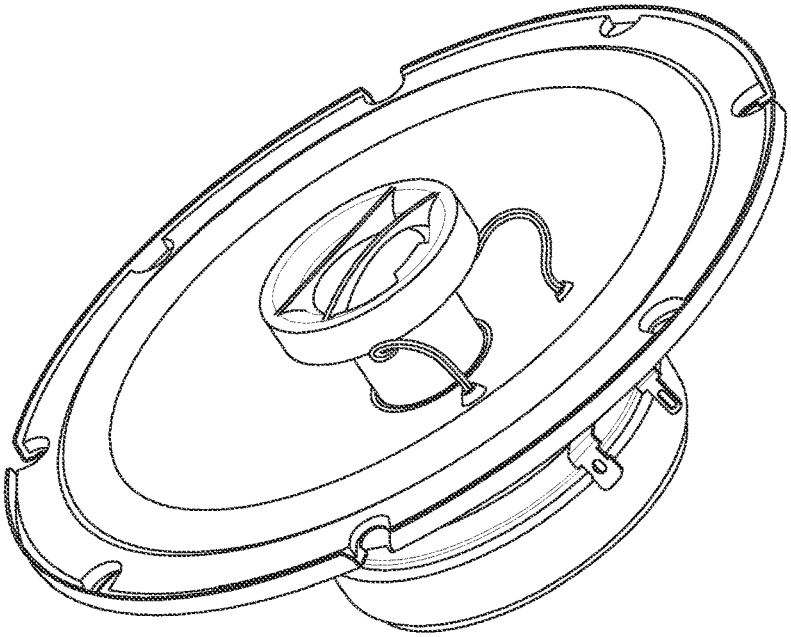
FIG. 3*c* shows a second possible approach to integrating a separate tweeter coaxially within a drive unit in a speaker system.
Figure 4A:
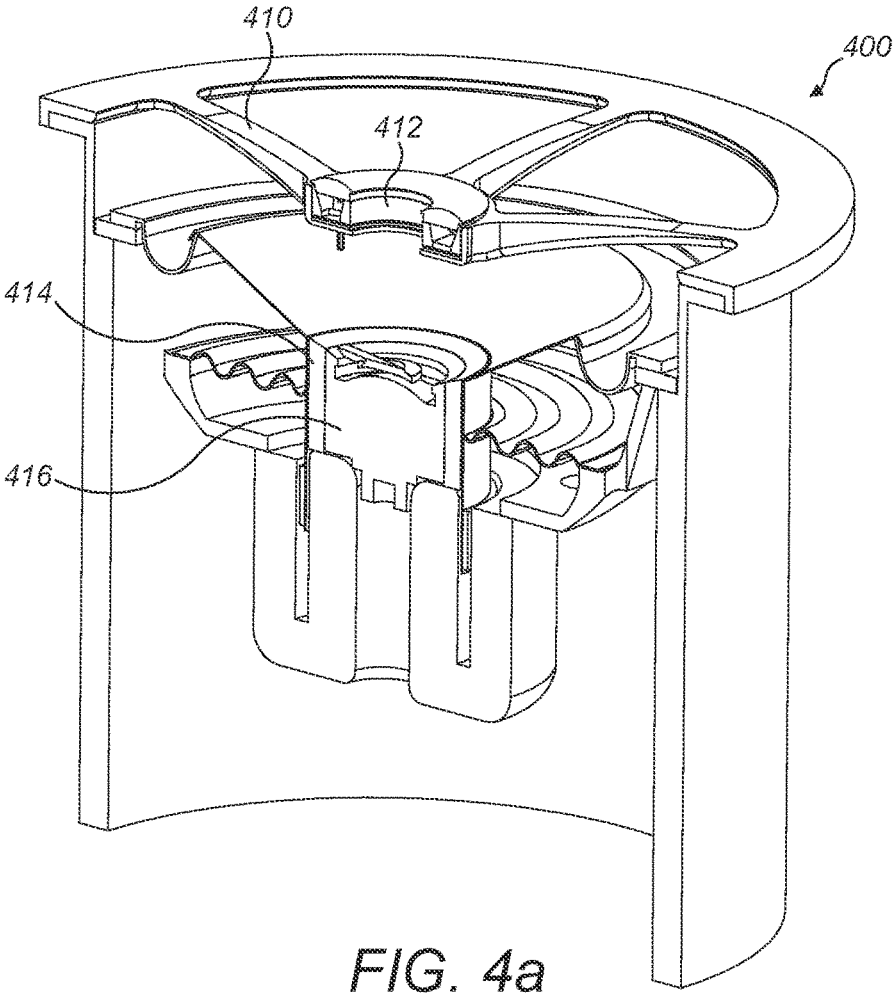
FIG. 4*a* shows a sectional view of a first example lighting and loudspeaker device.

FIG. 4*a* shows a sectional view of a first example lighting and loudspeaker device. The combined lighting and speaker device 400 according to the first example comprises a sparse grille 410, LED ring assembly 412, tweeter collar 414 and 13 mm tweeter 416.

Figure 4B:
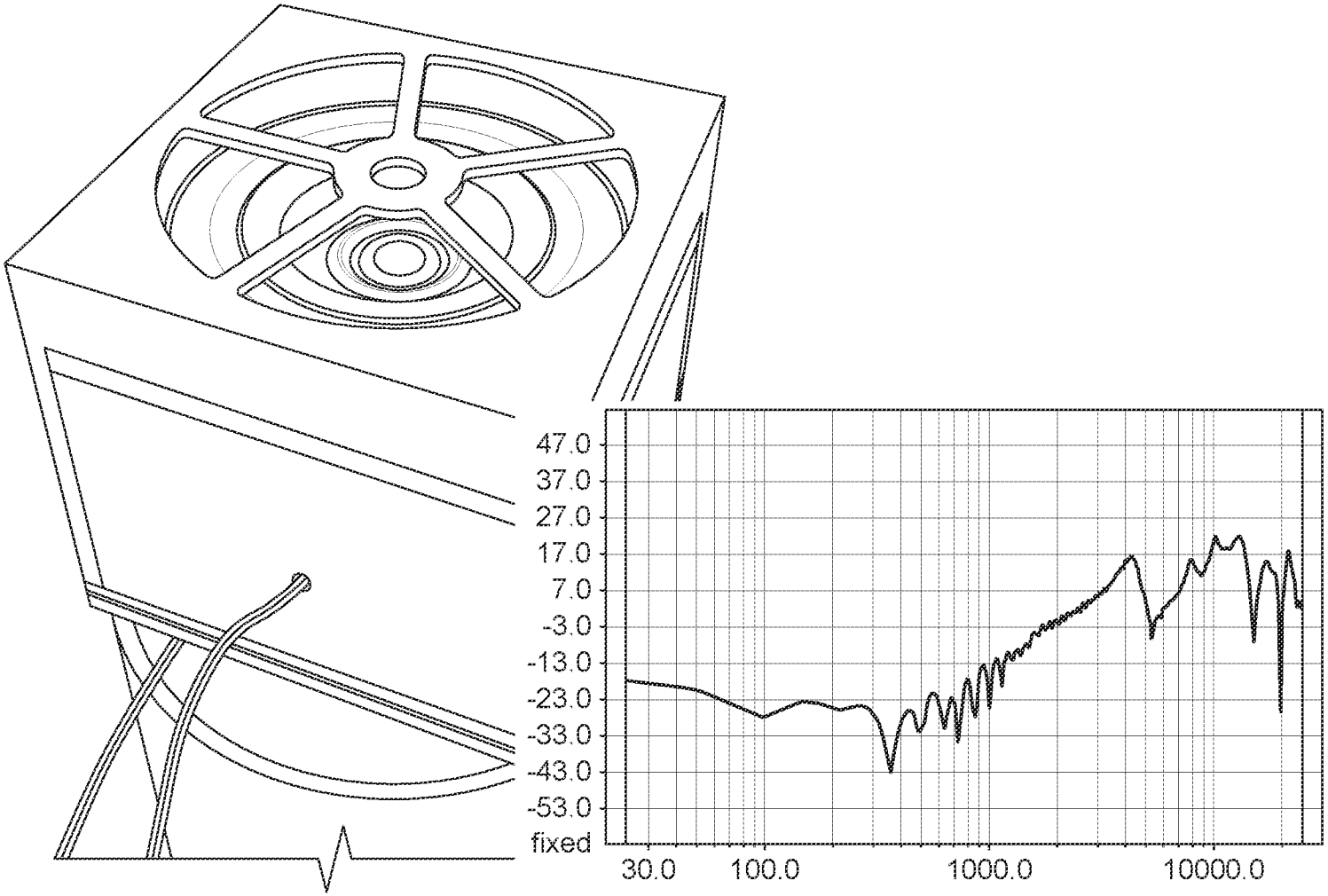
FIG. 4*b*, shows a prototype device including an integrated tweeter and LED arrangement on a sparse framework and a plot of the results of testing the prototype device.

The first example provides an integrated tweeter and a ring of LEDs suspended above the tweeter and supported on a sparse framework. HF interaction with the back of the LED ring may lead to unacceptable HF reproduction. As a result, this example is not preferred. FIG. 4*b*, shows a prototype device including an integrated tweeter and LED arrangement on a sparse framework. FIG. 4*b* also shows of a plot of the results of testing the prototype tweeter device. The objective is to create a "frequency response" which is as flat as possible so the sound pressure that is created by the system is the same at all frequencies.

FIG. 5*a* shows a sectional view of a second example lighting and loudspeaker device. The combined lighting and speaker device 500 according to the second example comprises a grille 510, outward LED array 512, 13 mm tweeter 514 and tweeter stem 516.

In this example, the tweeter is located on a stem with an annular arrangement of LEDs. One drawback associated with the second example, is undesirable interaction of the HF from the tweeter travelling backwards and interacting with the moving LF cone.

FIG. 5*b* shows a prototype device including a tweeter and LED arrangement on a stem and a plot of the results of testing the prototype tweeter device. This plot illustrates the effect on HF performance of the unmodified tweeter sitting above the LF cone.

Acoustic Solution to Problem of HF Interaction

The HF interaction with moving cone of main driver can be negated with the introduction of a "horn" around the tweeter which prevents HF sound from travelling backwards (or reduces the intensity of soundwaves travelling backwards), without introducing resonant effects. FIG. 6*a* shows a prototype device including a tweeter horn. FIG. 6*b* shows a plot of the results of testing the prototype device of FIG. 6*a*. The plot shows the frequency response for the LF cone (shown in dotted yellow) and the HF tweeter (shown in solid green).

The LF sound can escape freely through the gap between the horn and bezel.

This coaxial type speaker design exists in various prior art forms, mostly on larger drive units (see FIGS. 7*a* and 7*b*).

Acoustic performance can be further improved with the addition of "feathering" to the edge of the tweeter horn. FIG. 8 shows the results of testing the feathered tweeter horn. The axes are dB (vertical axis) against Frequency (Hz) (Horizontal axis). The effect of the notches in the rim of the tweeter horn can be seen in the plot of FIG. 8.

LED Speaker Integration with Improved Acoustics

FIG. 9*a* shows a sectional view of a first specific embodiment of the present invention. The combined lighting and speaker device 900 according to the first embodiment comprises a horn/grille 910, LED and tweeter carrier 912, LED/tweeter assembly 914, integrated cone and dustcap 916, integrated chassis/facia 918, spring mount 920 and M6 retaining screw 922.

The tweeter and LED assembly are mounted in a carrier 912 suspended by the grill 910 above the LF cone 916. The carrier may be made from aluminium or zinc or any other material of high thermal conductivity. The carrier 912 moves heat away from the LEDs into the air through the moulded grille 910.

The LEDs are arranged in a vertical "tombstone" orientation. A reflector is provided to reduce the thickness of the LED ring and to increase the number of LEDs from 8 to 20

The lens of the LED assembly becomes part of the tweeter horn.

The tweeter horn "feathers" into a grille, as can be seen in FIG. 9*a*. The grille allows LF sound from the rearward speaker to pass through.

The diameter of the voice coil may be increased to clear the LED tweeter carrier and use the integrated cone and dust cap for the LF driver. This addresses the problem of air gap leak and provides a device exhibiting improved acoustic performance.

The light source is suitably recessed. Wires from the tweeter and LED are run under the grille out of sight.

A variant of this preferred specific embodiment is shown in FIG. 9*b*. This embodiment uses a moulded carrier 950 to suspend the LED carrier, which may be a metal LED carrier. The moulded carrier may be made of a transparent or dark-coloured material so that the visibility of the carrier is reduced. A cosmetic grille 952 may be placed forwards of the carrier.

An Infra red (IR) proximity sensor and lens 954 are integrated into this variant and placed above the tweeter, acting as a "phase plug". Wires from the LED, tweeter and IR proximity sensor are run under one of the arms of this carrier via a ribbon cable 956. A flexible circuit 958 for a microphone array is also provided. The roll surround 960 may be configured as shown or, more preferably, may be inverted.

In a further variant of this embodiment, a dispersion cone is placed above the tweeter and the IR sensors sit on the top of the cone. The wires of the IR proximity sensor are run through the cone to combine with the LED and Tweeter cables, which then run under the arms of the carrier via a ribbon cable 956.

Features from these variants of the first embodiment may be combined, as will be appreciated by the skilled person.

LED Assembly

FIG. 10 shows an exploded view of an LED assembly 914, 1000 according to a second specific embodiment of the present invention. The LED assembly 1000 comprises an LED collar 1010, lens/horn 1012, vertical radial LED array 1014, thermal interface 1016, white optic reflector 1018 and 13 mm tweeter 1020.

FIG. 11 illustrates some example light paths during operation of LED assembly 912, 1000 according to the second specific embodiment of the present invention.

LEDs in the vertical orientation may emit inwards towards the tweeter. A conical polished polycarbonate white optic reflector redirects light forward and outward through the horn profile lens.

Increasing the number of LEDs to 20 improves the possibility of colour mixing by alternating cool and warm LED packages and independently controlling the brightness.

Alternative Example Configurations

As opposed to mounting the LEDs in vertical "tombstone" configuration, the LEDs 1210 may be mounted horizontally, as shown in LED assembly of FIG. 12. In this alternative, LEDS 1210 are arranged horizontally in a ring. Light from the LEDs either shines directly onto the lens 1220 or is reflected towards the lens using a reflector 1230. The lens focuses the light into the room, from where the lens appears as a uniformly lit ring 1240. The lens may be donut shaped. In this example, the reflector is provided by the polished face of a white polycarbonate part. Example light paths are shown at 1250, 1252 and 1254. Ray 1250 bounces off reflector 1230, whereas ray 1252 travels from the LED to the lens directly.

In a specific example, 8 LEDs can be arranged in a 24 mm diameter ring. The diameter is denoted by "x" in FIG. 12.

FIG. 13 shows an exploded sectional view of a horizontal LED ring assembly as described above in a combined lighting and speaker system. In this example, the LED assembly is supported by a cast frame 1310, which removes heat from and takes power to the LEDs. A cosmetic pressed grille 1320 is placed over the top. The central hole allows high frequencies through from the centre of the speaker cone.

FIG. 14 shows an exploded sectional view of another example similar to the example described above. In this example, the horizontal LED ring is held within a cast frame which manages heat and takes power to the LEDs, as with the example above. In the example of FIG. 14 a central tweeter 1410 is placed in the centre of the LED ring. A cosmetic grille is placed over the top.

In an alternative example shown in exploded sectional view in FIG. 15, a small LED is provided in an LED assembly module held within a cast frame 1510, which manages heat and takes power to the LEDs. A cosmetic pressed grille 1520 is placed over the top.

FIG. 16*a* shows a sectional view of another example of how a horizontal LED ring assembly may be integrated into a combined light and speaker system. In this example, the LED assembly is supported by a pressed grille, which removes heat from the LEDs by conducting heat away from the LED assembly and radiating it into the room. Power is transmitted to the LEDs through photo etched tracks 1610 on the rear of the grille. Electrical contacts 1620 for the tracks are provided in the frame.

FIG. 16*b* shows the above example in plan view where the photo etched tracks 1610 providing power to the LED assembly can be seen in between the grille pattern on the 3D form of the grille 1630.

FIG. 17 shows a sectional view of another example light and loudspeaker device with integrated horizontal LED ring assembly 1710 and tweeter 1720. The horizontal LED ring assembly is supported by a pressed grille, which conceals the power wires and removes heat from the LEDs. In the configuration of FIG. 17, the ring is wider allowing high frequencies from a coaxial tweeter through the central hole, as shown with arrow 1730. This also provides space for more LEDs in the LED ring assembly.

FIG. 18 shows a sectional view of a further example light and loudspeaker device with an LED mounted in a cage over the tweeter. The LED is supported in a cage over the top of the tweeter, where the placement disperses the high frequencies and helps reduce "beaming" form the tweeter. Beaming occurs when the high frequency sounds output from the tweeter are most audible directly in front of the device but less audible at angles away from the "normal" direction of the device. High frequency sound is significantly more directional than lower frequency and so at increased angles from the direction the tweeter is facing (the "normal" direction) the volume of HF sound will diminish but the LF will not. To counteract this effect, an "acoustic lens" or set of thin surfaces may be placed in front of the tweeter. This structure then acts to re direct and disperse the HF sound.

FIG. 19 shows a sectional view of an example of another combined lighting and loudspeaker device in which the LEDs in the LED ring assembly are mounted vertically. In this example, the LEDS are arranged vertically and reflected into the room with a reflector 1910 and focused with a donut shaped lens 1920. This means the diameter x of the ring can be smaller with more LEDs (16 in a 21 mm ring in the example shown). This many LEDs can also be arranged in alternating colour temperature as shown, giving colour temperature control. An example light path is shown with arrow 1930.

FIG. 20 shows a sectional view of another example of a combined lighting and loudspeaker device. In this example, a vertical LED ring is provided on a pole piece. The Vertical LED Ring is slender enough to be mounted on a pole piece. The heat is managed through this pole piece, as shown with arrow 2010.

FIG. 21 shows a sectional view of another example of a combined lighting and loudspeaker device. In this example, a vertical LED ring assembly is provided on a pole piece with an integrated tweeter. The vertical LED ring allows High Frequency sound through its centre. This means the LED assembly can be mounted over a tweeter. The heat is managed through this pole piece, as shown with arrow 2110.

FIG. 22 shows a sectional view of another example of a combined lighting and loudspeaker device. In this example, a convex speaker cone 2210 with a cosmetic face is provided along with a vertical LED ring assembly 2220 with an integrated dome tweeter 2230. The Convex cone gives more volume in the cabinet and therefore improves broadcast of the sound into the room and becomes the cosmetic face of the product. Heat may be removed from the components through a central pole piece, as shown with arrow 2240. The central pole piece may also be used to supply power to the components.

FIG. 23 shows a sectional view of another example of a combined lighting and loudspeaker device. This example includes a grille, cosmetic bezel, and LED carrier all combined in a single component 2310. This combined component supports the LED tweeter assembly 2320.

Advantageously, the combined grille and LED carrier component, simplify construction and assembly and provide an improved surface area for heat transfer from the LEDs. This configuration also removes split lines from cosmetic surfaces.

FIG. 24 shows a sectional view of another example of a combined lighting and loudspeaker device. In this example, the LED and tweeter assembly 2410 is supported on a pole piece stand off 2420, which may be disconnected from the grill.

Advantageously, this configuration provides a more robust heat path for heat removal from the LEDs by thermally connecting them to the thermal mass of the magnet steel. More powerful variants of the lighting and speaker system may benefit from this configuration.

FIG. 25 shows a sectional view of another example of a combined lighting and loudspeaker device. This example includes a ring radiator tweeter 2510 and a single large chip LED and lens assembly 2520 placed centrally of the ring radiator tweeter. This configuration provides a more directional light source using a conventional lens. An acoustic horn 2530 is still used to prevent backward leakage of HF sound.

Another version of this would remove the square bezel and allow for the combined lighting and loudspeaker device to be recessed into the ceiling. This creates an option where the lighting speaker units can be installed so that they are flush with the ceiling and can be concealed within plaster on the ceiling.

Additional Improvements

FIG. 26 shows a sectional and perspective view of a combined light and loudspeaker device that includes ports within the wall of the device. These ports allow the bass response of the speaker to be greatly improved. The smooth-walled ports 2610 are incorporated within the walls of the product, exiting down in to the room at one or more ports 2620. There could be a single port or many arrayed radially. The ports may be flared on entry and exit to reduce audible turbulence. The ports and channels may have no sharp corners to allow smooth airflow. Many different in-wall configurations are possible.

FIG. 27 shows a sectional view of an example combined light and loudspeaker device that includes a coaxial port 2710 running down the pole piece.

FIG. 28 shows two sectional views of example combined light and loudspeaker devices that include an elbow to increase the volume of the cavity enclosed in the device. A larger enclosed volume means a better speaker performance. The device could form an elbow shape to increase this volume, whilst it is still possible to fit the device into the ceiling cavity. Smooth curves are used in the internal device cavity where possible in order to advantageously improve airflow.

FIG. 29 shows a sectional view of an example combined light and loudspeaker device that includes a battery. This battery in the device allows the system to transition smoothly between modes. A rechargeable battery 2910 may be incorporated into the product, in the main body. Alternatively or additionally, a rechargeable battery may be provided in an umbilical pack 2920.

The battery may be constantly recharged during use. It can give around 10 minutes of life, to ensure a smooth transition if the light switch is accidentally switched. In this event, settings are saved and there are no speaker pops. The user may be alerted to turn the switch back on and use the app or voice to control the lights. The light switch can now be used as an input by using an on/off on/off pattern as a gesture to reset the system, for example.

In an alternative embodiment, a capacitor may be used in place of the rechargeable battery. The capacitor can store energy from the main power supply as provided while the device is attached. In the event that the power is cut to the main power supply, the capacitor will supply its stored electricity into each individual device until such time as it is out of stored electricity.

Definitions

In the context of this application, the terms "inner" and "inward" refer to components and directions that are closer to the central axis of the device or towards the central axis of the device. Likewise, "outer" and "outward" refer to components and directions that are further away from the central axis of the device.

"Forward" and "rearward" refer to directions that are towards the room or the ceiling cavity when the device is installed in the ceiling, respectively.

"Annular" means shaped as a ring. In the embodiments shown, the annular components are shown as circular rings and described as "donut-shaped". However, these components do not need to be circular. They could be square or rectangular or a number of other shapes. In all cases, they will have an inward hole that is characteristic of annular arrangements.

The phase "in communication with" means, in the context of this application, placed adjacent to so that air can flow smoothly between the components. As a result, sound waves may also travel between components that are in communication with each other. Within the meaning of "adjacent", the components may be spaced apart with additional components in between that allow air to flow smoothly between the components (such as spacers, washers, thermal coupling materials and the like).

"Frustoconical" means having the shape of a frustum of a cone. "Frustopyramidal" means having the shape of a frustum of a pyramid. An "inner frustoconical surface" is the inside surface of the frustrum of the cone and an "outer frustoconical surface" is the outside surface.

In the case where the annular LED assembly is not a circular "donut-shaped" annular assembly, frustopyramidal surfaces may be more appropriate for the reflectors and tweeter horns, rather than frustoconical surfaces.

Combinations

Various embodiments have been described above to illustrate a number of different advantageous features. As will be appreciated by the skilled person, these features may be combined in various ways to produce many different lighting and speaker devices.

What is claimed is:

1. A combined lighting and speaker device having a central longitudinal axis defining a forward and a rearward direction and a radially outward and a radially inward direction, the device comprising:

a tweeter;

a tweeter horn positioned radially outwardly of the tweeter;

a speaker positioned rearward of the tweeter horn; and a light emitting diode, LED, assembly positioned radially outwardly of the tweeter, the LED assembly comprising one or more light emitting diodes, LEDs, and a lens having a forward surface, wherein the tweeter horn has an inner edge in communication with an outer edge of the tweeter, so that the tweeter horn forms a guide to direct sound produced by the tweeter away from the speaker when in use, wherein at least part of the tweeter horn is provided by the forward surface of the lens.

2. The device of claim 1, wherein the tweeter horn comprises a cup part, and wherein an inner edge of the cup part is in communication with an outer edge of the forward surface of the lens.

3. The device of claim 2, wherein the tweeter horn comprises a rim part having an inner edge that is in communication with the outer edge of the cup part, wherein an outer edge of the rim part comprises one or more notches through which sound from the speaker can travel when in use.

4. The device of claim 1, wherein the one or more LEDs are mounted rearward of the lens so that light is emitted by each of the LEDs in a generally forward direction towards the lens when in use.

5. The device of claim 1, wherein the LED assembly further comprises a reflector configured to reflect light from the LEDs towards the lens when in use.

6. The device of claim 5, wherein the one or more LEDs are mounted so that light is emitted by each of the LEDs in a generally inward direction towards the reflector.

7. The device of claim 5, wherein the reflector comprises one or more frustoconical surfaces.

8. The device of claim 5, wherein the reflector comprises a plurality of individual reflector surfaces.

9. The device of claim 1, wherein the lens is an annular lens.

10. The device of claim 1, wherein an inner edge of the forward surface of the lens is in communication with the outer edge of the tweeter.

11. The device of claim 1, wherein the tweeter horn further comprises a throat part, wherein an inner edge of the throat part of the tweeter horn is in communication with the outer edge of the tweeter and an outer edge of the throat part is in communication with an inner edge of the forward surface of lens.

12. The device of claim 1, wherein the tweeter horn is frustoconical or frustopyramidal.

13. The device of claim 1, wherein the LED assembly is arranged in a ring, wherein the lens is an annular lens, and wherein the LED assembly further comprises an annular reflector configured to reflect light from the LEDs towards the lens when in use.

14. The device of claim 13, wherein the one or more LEDs are mounted so that light is emitted by each of the LEDs in a generally inward direction towards the reflector.

15. The device of claim 13, further comprising chassis that supports the speaker.

16. The device of claim 1, further comprising a power storage component, wherein the power storage component is configured to supply power to the lighting and loudspeaker device when the lighting and loudspeaker device is not connected to a mains power supply.

17. The combined lighting and loudspeaker device of claim 16, wherein the power storage component is a rechargeable battery or a capacitor.

* * * * *